US010269335B1

(12) United States Patent
O'Hair et al.

(10) Patent No.: US 10,269,335 B1
(45) Date of Patent: Apr. 23, 2019

(54) MUSICAL INPUT DEVICE

(71) Applicant: IRIJULE, INC., Benicia, CA (US)

(72) Inventors: Scott M. O'Hair, Benicia, CA (US); Evan M. Swanson, Benicia, CA (US)

(73) Assignee: IRUULE, INC., Benicia, CA (US)

( * ) Notice: Subject to any disclaimer, the term of this patent is extended or adjusted under 35 U.S.C. 154(b) by 0 days.

(21) Appl. No.: 15/950,043

(22) Filed: Apr. 10, 2018

Related U.S. Application Data

(60) Provisional application No. 62/485,083, filed on Apr. 13, 2017.

(51) Int. Cl.
*G04B 13/00* (2006.01)
*G10H 1/00* (2006.01)
*G10H 1/34* (2006.01)

(52) U.S. Cl.
CPC ..... *G10H 1/0008* (2013.01); *G10H 1/344* (2013.01); *G10H 2210/571* (2013.01); *G10H 2220/221* (2013.01)

(58) Field of Classification Search
CPC ..... G10H 1/0008; G10H 1/344; G10H 2210/571; G10H 2220/221
USPC ..... 84/609
See application file for complete search history.

(56) References Cited

U.S. PATENT DOCUMENTS 5,440,071 A * 8/1995 Johnson ..... G10H 1/34 84/637
5,646,648 A * 7/1997 Bertram ..... G06F 3/0219 341/22
5,856,795 A * 1/1999 Arnold ..... G06F 3/023 264/189
6,063,994 A * 5/2000 Kew ..... G10H 1/0008 84/600
6,351,225 B1 * 2/2002 Moreno ..... G06F 3/0219 341/22
6,444,888 B1 * 9/2002 VanDruff ..... G10H 1/20 84/423 R
7,394,010 B2 * 7/2008 Nishibori ..... G10H 1/06 84/464 A
8,354,580 B2 * 1/2013 Bowen ..... G10H 1/34 84/718
9,159,307 B1 * 10/2015 Ludovici ..... G10H 1/0066
2003/0209130 A1 * 11/2003 Anderson ..... G10H 1/34 84/443
2006/0123982 A1 * 6/2006 Christensen ..... G10H 1/0066 84/723

(Continued)

*Primary Examiner* — Jeffrey Donels
(74) *Attorney, Agent, or Firm* — Lindauer Law, PLLC

(57) ABSTRACT

An input device accepts user input and generates data indicative of notes, such as MIDI data. The input device includes a set of chord keys and a set of melody keys. A desired scale is selected, and the chord keys and melody keys are configured to utilize notes associated with that scale. The chord keys may be representative of all non-inverted chords associated with that scale. Inverted chords may be accessed using other keys or key combinations. Upon activation of an individual chord key, MIDI data representative of the notes in that chord is generated. Upon activation of an individual melody key, MIDI data representative of a single note from the scale is generated. Conflicts between notes associated with activated and released keys are resolved. Keys illuminated with a color associated with a particular note facilitate user recognition of that note in the chord keys and melody keys.

20 Claims, 15 Drawing Sheets

(56) References Cited

U.S. PATENT DOCUMENTS

| | | | | |
|---|---|---|---|---|
| 2008/0173163 | A1* | 7/2008 | Pratt | G10H 1/20 84/645 |
| 2009/0114078 | A1* | 5/2009 | Plamondon | G10H 1/34 84/423 R |
| 2014/0033897 | A1* | 2/2014 | Bludov | G10C 3/12 84/423 R |
| 2014/0076126 | A1* | 3/2014 | Terry | G10H 1/34 84/609 |
| 2016/0232883 | A1* | 8/2016 | Velez-Gallego | G10H 1/34 |
| 2017/0116970 | A1* | 4/2017 | Ua-Aphithorn | G10D 11/00 |

* cited by examiner

MUSICAL INPUT DEVICE

PRIORITY

This application claims priority from and the benefit of U.S. Provisional Patent Application No. 62/485,083, entitled "Musical Input Device" filed Apr. 13, 2017. Application 62/485,083 is incorporated by reference herein in its entirety.

BACKGROUND

Expression through music is a uniquely human experience. Such expression may involve a musician utilizing an instrument to produce a particular sound or set of sounds. Musicians continue to look for ways that allow them to play more efficiently, effectively, and easily.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
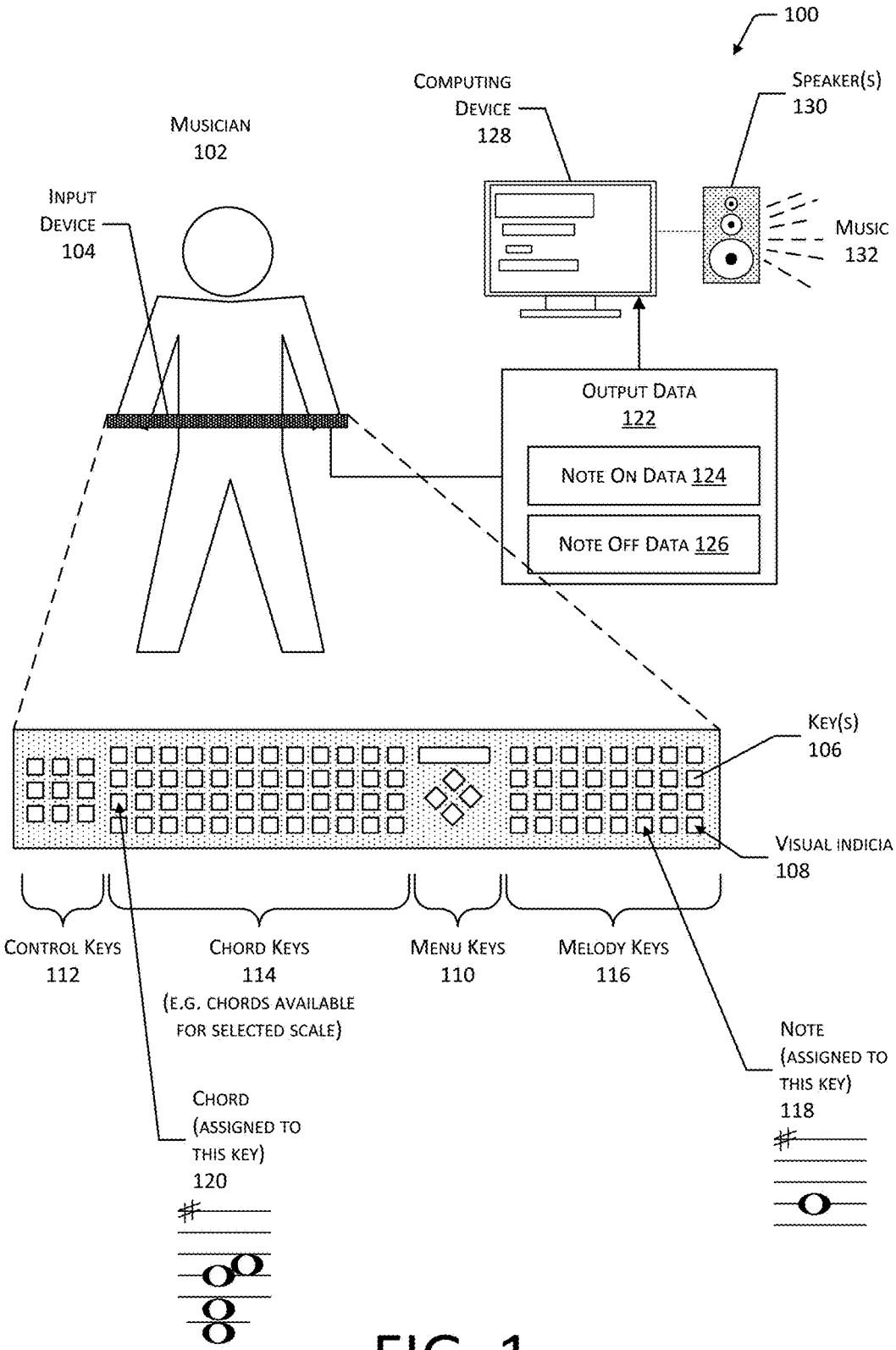
FIG. 1 depicts a system in which a musician uses an input device with chord keys and melody keys that may be used to play electronic musical instruments, according to one implementation.

Elements of the figures are presented by way of illustration and not necessarily as a limitation. Size, proportion, or other aspects of the figures may be exaggerated for clarity. While various implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

A musician may utilize many tools to create music. These tools may include their own voice, objects, mechanical instruments, or electronic instruments. The basic building blocks of music are scales, notes, and chords. A sound having a particular pitch is represented by a note. Different notes represent different pitches. A musical scale (or "scale") defines a particular set of notes that may be played together. For example, a scale such as B Phrygian scale includes the notes B, C, D, E, F#, G, and A. Several notes may be combined to form chords. The formation of chords may utilize various rules known in music theory that specify intervals between notes. For example, the Bm7(#5) chord in the B Phrygian scale consists of the notes B, D, G, and A. Notes within the chord may be played either simultaneously or in quick succession as an arpeggio.

Mechanical instruments require the musician to manipulate the particular instrument in order to produce desired sounds. For example, a pianist must sit at the piano and manipulate the keys and pedals to play a piece. A horn player must control breath, embouchure, and valves to produce the desired notes.

In comparison, electronic musical instruments allow the musician to produce sounds that simulate or replicate a mechanical instrument, or sounds that are completely unrelated to any mechanical instrument. Electronic musical instruments also offer advantages in terms of convenience, economy, and so forth. For example, a musician may have a single small electronic musical instrument that can produce the sounds of fifty different pianos on command.

In addition to the ability to produce a variety of different sounds associated with many different instruments, electronic musical instruments allow for a decoupling between the mechanism of input from the instrument being played. For example, a controller may be used to generate information indicative of input from the user. That information may then be used by a computing device to determine what sounds to play. In this way, an electronic keyboard may be used to produce the sound of notes from a grand piano or the sound of a snare drum.

In spite of this decoupling, traditional mechanical layouts remain prevalent. For example, the piano keyboard layout is commonly used by musicians as an input device. However, layouts such as the piano keyboard are the result of their mechanical past. The linear layout and spacing of keys on a piano keyboard were originally intended to accommodate the limits of mechanical actions, and not to accommodate the musician.

Described in this disclosure is an input device used to generate output data suitable for use by electronic musical instruments. The input device includes a group of chord keys and a group of melody keys. Each group of keys are arranged in an array of rows or columns. In other implementations, other arrangements may be used. The musician may select a particular scale they wish to use. Once selected, each of the chord keys is associated with a particular chord for that scale. Likewise, each melody key is associated with a particular note of the scale. By pressing a single chord key of the input device, the musician may thus play the associated chord that is made up of the constituent notes. In contrast, with the traditional piano keyboard, to play the chord the user must know the particular grouping of individual notes and play those simultaneously. To play a single note or combination of single notes, the desired individual melody keys are pressed.

Visual indicia may be used to provide the musician with information about the relationship between the chord keys and the melody keys. For example, a key may include a multi-color light emitting diode (LED) that may be operated to provide different colors of illumination to the portion of the key that is visible. In other implementations, other techniques may be used to provide visual indicia.

A particular color may be associated with a particular note within the scale. For example, all B notes may be assigned red, C notes may be orange, D notes white, and so forth. The color of a chord key may be associated with the root note for that particular chord. Continuing the example, the key that is assigned to the chord Bm7 may be illuminated red. The color of the melody key may also be associated with that particular note. Continuing with the example, the melody keys that assigned respectively to B, B1, B2, B3, etc. may be illuminated red. During play, the musician is thus easily able to ascertain information such as the note of a melody key or root note of a chord key.

Additional controls may be available well. For example, controls may be provided to allow for the selection of the scale, to increase or decrease octaves, and so forth. In some implementations the input device may include one or more display or other output devices. For example, the input device may include a display that is used to present the currently selected scale, display other scales that are available, and so forth.

During play, the musician presses and releases keys to produce the desired sounds. In some situations different and perhaps even contradictory inputs may be received for the same note. For example, the musician may play the Bm7(#5) chord by holding the appropriate chord key, and may then also play a B note using the appropriate melody key. A release of the chord key should result in the other notes in that chord no longer being played, while the B note continues so long as the melody key is pressed.

Techniques for resolving these conflicts and determining which notes are to be played are also discussed. Once determined, the input device may create output data indicative of the change in state to the keys that represents the musician playing the input device. In one implementation, the output data may be compliant with at least a portion of the Musical Instrument Digital Interface (MIDI) technical standard. The output data may be sent to a computing device that processes the output data to determine which sounds to present, and may subsequently present those sounds.

By using the input device and techniques described above, musicians are able to more easily and swiftly play music. The use of chord keys to present many, if not all, chords associated with a particular scale greatly simplifies the workload on the musician to play a particular chord. The use of visual indicia eases the cognitive load of the musician by providing easily accessible visual confirmation of common root notes in chord keys, in associating particular melody keys with particular notes, and in showing the relationship between the notes in the melody keys to the corresponding root notes in the respective chord keys. As a result, the musician is able to swiftly and easily play music that uses chords as well as individual notes.

FIG. 1 depicts a system 100 in which a musician 102 uses an input device 104 to play electronic musical instruments, according to one implementation.

The input device 104 comprises keys 106 or other devices that are responsive to an input from the musician 102. During play, the musician 102 manipulates the keys 106 to produce the desired sounds. The keys 106 may provide output indicative of an activation or deactivation of the key 106. The keys 106 may comprise a control mechanism responsive to physical force such as a touch provided by the musician 102. In one implementation, the keys 106 may comprise buttons that deform or are displaced upon application of force and then are mechanically biased to return to substantially the same physical configuration after the force is removed. During operation, the key 106 may thus provide an indication as to when pressed or released.

In other implementations, other control mechanisms may be used. For example, the keys 106 may comprise force sensitive resistors, capacitive touch sensors, resistive touch sensors, solid state switches, accelerometers, touchscreens, and so forth. In some implementations, the keys 106 may provide other information in addition to an on/off state. For example, a force sensitive resistor may be used to provide information indicative of a change in applied force over time. In still other implementations, the keys 106 may be virtual, such as presented to the musician 102 using a projector, display, and so forth. For example, the input device 104 may appear as a computer-generated object in a virtual or augmented reality space. Different control mechanisms may be utilized with the same input device 104. For example, some keys 106 may be mechanical switches, while others are capacitive touch sensors, and so forth.

The keys 106 are configured to present one or more visual indicia 108. The visual indicia 108 may comprise one or more of color, text, image, or shape of the key. In some implementations, the visual indicia 108 may include different colors of illumination, different colors presented on a display, border colors, graphics, and so forth. For example, the keys 106 may be constructed with a translucent or transparent keycap and a light source that illuminates the keycap. The light source may be configured or driven to provide different colors. For example, a multicolor light emitting diode (LED) may be configured to provide red, orange, yellow, green, blue, and violet colors. The visual indicia 108 may be used to provide the musician 102 with information about the notes associated with a particular key 106. The visual indicia 108 may be dynamically reconfigurable, such that as the input device 104 is reconfigured, the individual visual indicia 108 of a particular key 106 may change.

The keys 106 may be arranged into various groups that provide different functions. These groups may include one or more of menu keys 110, control keys 112, chord keys 114, and melody keys 116. The groups of keys 106 may be arranged into rows and columns, such as shown here, or may be placed into other configurations. For example, the chord keys 114 and melody keys 116 may be arranged in concentric arcs.

The basic building blocks of music are scales, notes, and chords. A sound having a particular pitch is represented by a note 118. Different notes 118 represent different pitches. A musical scale (or "scale") defines a particular set of notes that may be played together. For example, a scale such as B Phrygian scale includes the notes B, C, D, E, F#, G, A, B.

Several notes 118 may be combined to form chords 120. A chord 120 may be constructed from the five, seven, or eight notes that make up a particular scale. Using existing rules of music theory, certain combinations of these notes are accepted while others are prohibited. Chord structures may include: Major triads, Minor triads, 7th chords, 7th chords with a sharpened 5th, suspended 4th chords, 7th chords with a suspended 4th, added 2nd chords, 6th chords, major 7th chords, 6th chords with an added 9th, major 7th chords with an added 9th, flattened 5th chords, 6th chords with a flattened 5th, suspended 2nd chords, 9th chords, diminished chords, minor 7th with a flattened 5th, diminished 7th chords, augmented chords, 7th chords with a flattened 9th, 7th chords with a sharpened 9th, major 7th chords with an added 4th, major 7th chords with a sharpened 5th, 7th chords with a flattened 5th and a sharpened 9th, major 7th with a flattened 5th, or 7th chords with an added 9th and a sharpened 11th. For example, the Bm7(#5) chord in the B Phrygian scale consists of the notes B, D, G, and A. Notes 118 within the chord 120 are typically played simultaneously, but in some implementations may be played in quick succession, as an arpeggio.

The menu keys 110 allow the musician 102 to configure the input device 104 to operate using a particular scale. For example, the menu keys 110 may allow the user to select from a number of different musical scales. Once selected, the input device 104 may be configured as described below. For example, particular notes 118 and chords 120 may be associated with particular keys 106, the visual indicia 108 may be configured for particular keys 106, and so forth. In other implementations, the menu keys 110 may be omitted. For example, the input device 104 may receive commands from an external device.

The group of control keys 112 may be configured to allow the musician 102 to modify operation of the input device 104 during play. For example, the control keys 112 may be used to change octaves, add effects such as sustain or reverb, activate a chord inversion, and so forth. A shift in octave may comprise adding or subtracting twelve semitones to the notes 118. A chord inversion may comprise changing a chord 120 such that one of the notes 118 in that chord 120 is dropped down by one octave.

The chord keys 114 provide the musician 102 with easy access to the chords 120 that are associated with the selected scale. An individual chord key 114 is associated with a particular chord 120. In order to play a particular chord 120, the musician 102 activates the desired chord key 114.

The melody keys 116 allow the musician 102 to play individual notes 118 or other combinations of notes 118 that may not be expressed in a chord 120 for that scale. By manipulating the chord keys 114 and the melody keys 116, the musician 102 is able to easily play complex musical arrangements. For example, when trying to play the B Phrygian chord of Bm7(#5), the musician 102 does not need to remember the four constituent notes, but instead simply needs to know the corresponding key 106 in the chord keys 114 that will produce the desired sounds.

To facilitate operation, the visual indicia 108 provides the musician 102 with an indication of what notes 118 are associated with particular keys 106. For example, the B note may be associated with red. The B notes on the melody keys 116 may all be colored red. Likewise, the chord keys 114 that utilize a B root note may also be colored red. In this way, the musician 102 can readily find chords 120 that utilize the same root note 118, as they have the same color. Similarly, the consistent visual indicia 108 used on the chord keys 114 and the melody keys 116 improves the ability of the musician 102 to find particular keys 106 that share a common note 118. The visual indicia 108 also facilitates quick identification of particular notes 118 and distinction between different notes 118.

During operation, a hardware processor of the input device 104 may generate output data 122. The output data 122 may comprise information indicative of the state of the keys 106. In some implementations the output data 122 may be compliant with at least a portion of the musical instrument digital interface (MIDI) technical standards as promulgated by the MIDI Manufacturers Association. For example, the output data 122 may include note on data 124 and note off data 126. The note on data 124 designates a particular note 118 and that the particular note 118 is designated to be played. The note off data 124 designates a particular note 118 and that the particular note 118 is designated to have play stop. For example, when the musician 102 presses the melody key 116 associated with the note B1, note on data 124 is generated that designates notes B1 is to be played. Continuing the example, when the musician 102 releases that melody key 116, note off data 126 is generated that designates play of note B1 is to be discontinued. The output data 122 may include other information, such as information indicative of a particular instrument, key velocity, key pressure, key acceleration, and so forth. Continuing the example, the note on data 124 may be indicative of the timing and force with which the musician 102 struck the melody key 116.

The output data 122 is provided to a computing device 128 via a communication interface. The computing device 128 receives the output data 122 and may then use this information in a variety of ways. For example, the output data 122 may be processed and audio signals may be generated. The audio signals may be presented by a speaker 130 that renders aloud music 132 that the musician 102 has played. In one implementation the computing device 128 may be an electronic musical instrument, a computer executing software, or a combination thereof.

In some implementations the computing device 128 or other external device may be used to control one or more functions of the input device 104. For example, the computing device 128 may send commands to set the input device 104 to utilize a particular scale. In another example, the computing device 128 may send data to the input device 104 that is used by the input device 104 to assign particular notes 118, chords 120, or other functions to particular keys 106.

Instead of, or in addition to the MIDI technical standards, the input device 104 may use one or other technical standards. For example, the input device 104 may be compatible with at least a portion of one or more standards such as HD-MIDI, RTP-MIDI, Open Sound Control (OSC), and so forth. The communication interface may utilize a wired serial interface, other wired interfaces such as Ethernet, wireless interfaces, and so forth. For example, the input device 104 may utilize the Bluetooth® or WiFi® protocols to communicate with the computing device 128.

Figure 2:
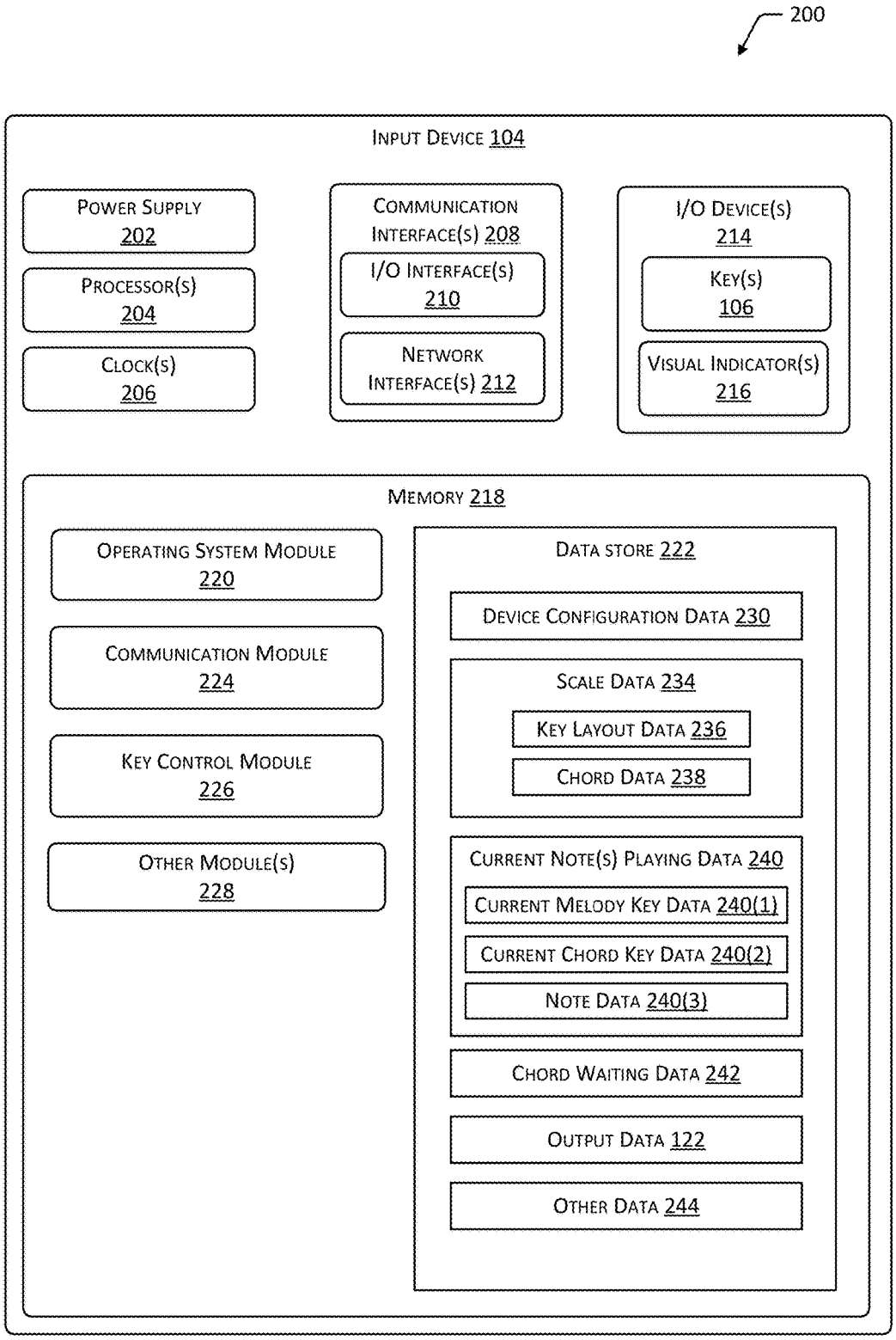
FIG. 2 is a block diagram of the input device, according to one implementation.

FIG. 2 is a block diagram 200 of the input device 104, according to one implementation. The input device 104 may comprise a general purpose computer, system on a chip (SoC), microcontroller, or other device that has been programmed or otherwise configured to provide the following functions. For example, the input device 104 may utilize an Arduino single-board microcontroller.

The input device 104 may include one or more power supplies 202 configured to provide electrical power suitable for operating the components of the input device 104. In some implementations, the power supply 202 may include a rechargeable battery, fuel cell, photovoltaic cell, power conditioning circuitry, wireless power receiver, and so forth.

The input device 104 may include one or more hardware processor(s) 204 (processors) configured to execute one or more stored instructions. The processor(s) 204 may include one or more cores. One or more clocks 206 may provide information indicative of date, time, ticks, and so forth. For example, the processor(s) 204 may use data from the clock 206 to generate a timestamp, trigger a preprogrammed action, and so forth.

The input device 104 may include one or more communication interfaces 208, such as input/output (I/O) interfaces 210, network interfaces 212, and so forth. The communication interfaces 208 may enable the input device 104, or components of the input device 104, to communicate with other devices or components of the input device 104. The I/O interfaces 210 may include interfaces such as MIDI, Inter-Integrated Circuit (I2C), Open Sound Control (OSC), Serial Peripheral Interface bus (SPI), Universal Serial Bus (USB), RS-232, and so forth.

The network interfaces 212 may be configured to provide communications between the input device 104 and other devices, such as the computing devices 128, routers, access points, and so forth. The network interfaces 212 may include devices configured to couple to one or more networks including local area networks (LANs), WLANs, wide area networks (WANs), wireless wide area networks (WWANs), and so forth. For example, the network interfaces 212 may include devices compatible with Ethernet, Wi-Fi®, Bluetooth®, ZigBee®, Z-Wave, 3G, 4G, LTE, and so forth.

The I/O interface(s) 210 may couple to one or more I/O devices 214. The I/O devices 214 may include any manner of input device or output device associated with the input device 104. For example, I/O devices 214 may include the keys 106, touch sensors, keyboards, mouse devices, microphones, image sensors (e.g., cameras), scanners, geolocation or other positioning devices, visual indicators 216, displays, speakers 130, haptic devices, printers, and so forth. The positioning device may comprise one or more of a satellite radionavigation system, inertial navigation system, terrestrial radionavigation system, or other device configured to generate data indicative of the geolocation. The I/O devices 214 may be physically incorporated with the input device 104 or may be externally placed. For example, the I/O devices 214 may include a foot pedal that is connected wired or wireless to the input device 104.

The visual indicators 216 may comprise devices configured to produce the visual indicia 108. For example, the visual indicators 216 may comprise light emitting diodes (LED), quantum dots, electroluminescent elements, electrophoretic elements, cholesteric elements, optically interferometric elements, and so forth. The visual indicators 216 may be emissive, in that they emit photons, or they may be reflective in that they reflect ambient light. For example, an LED is an emissive visual indicator 216. In comparison, liquid crystal, electrophoretic, cholesteric, and optically interferometric devices interact with ambient light to produce a visual effect.

The visual indicators 216 may be integrated with the keys 106, or may be separate from them. For example, the upper surface of the key 106 that is visible during normal use may comprise the visual indicator 216. In another example, the keycap of a key 106 may be a transparent or translucent while the visual indictor 216 below or to the side provides illumination to that keycap, causing the keycap to appear the color of the visual indicator 216 when active.

While the keys 106 are depicted as exhibiting the visual indicia 108, in other implementations other techniques may be used. For example, the keys 106 may be unchanged while a border or light next to the key 106 exhibits the visual indicia 108.

The input device 104 may include one or more busses or other internal communications hardware or software that allows for the transfer of data between the various modules and components of the input device 104.

As shown in FIG. 2, the input device 104 may include one or more memories 218. The memory 218 may include one or more non-transitory computer-readable storage media (CRSM). The CRSM may be any one or more of an electronic storage medium, a magnetic storage medium, an optical storage medium, a quantum storage medium, a mechanical computer storage medium, and so forth. The memory 218 may provide storage of computer-readable instructions, data structures, program modules, and other data for the operation of the input device 104. A few example modules are shown stored in the memory 218, although the same functionality may alternatively be implemented in hardware, firmware, or as a system on a chip (SoC).

The memory 218 may include one or more operating system (OS) modules 220. The OS module 220 may be configured to manage hardware resource devices such as the I/O interfaces 210, the network interfaces 212, the I/O devices 214, and to provide various services to applications or modules executing on the processors 204. The OS module 220 may implement a variant of the FreeBSD™ operating system as promulgated by the FreeBSD Project; UNIX™ or a UNIX-like operating system; a variation of the Linux™ operating system such as Raspbian or Android; the Windows® operating system from Microsoft Corporation of Redmond, Wash., USA; the Mac OS® or iOS™ promulgated by Apple Inc. of Cupertino, Calif., USA; the TinyOS promulgated by the TinyOS Alliance, or other operating systems.

A data store 222 may also be stored in the memory 218. The data store 222 may use a flat file, database, linked list, tree, executable code, script, or other data structure to store information. In some implementations, the data store 222 or a portion of the data store 222 may be distributed across one or more other devices including other input devices 104, network attached storage devices, and so forth.

The memory 218 may store other modules including a communication module 224, a key control module 226, or other modules 228. The modules may be executed as foreground applications, background tasks, daemons, and so forth.

The communication module 224 may be configured to establish communications with one or more other devices using one or more of the communication interfaces 208. Communications may be authenticated, encrypted, and so forth. For example, the communication module 224 may utilize digital certificates to authenticate the identity of devices involved in the communication. For example, the communication module 224 may be configured to establish a virtual private network (VPN) connection or tunnel with the computing device 128.

The key control module 226 performs various functions associated with operation of the input device 104. The key control module 226 may utilize device configuration data 230 stored in the data store 222. For example, the device configuration data 230 may indicate default settings, user preferences, and so forth.

The key control module 226 may access scale data 234 stores in the data store 222. The scale data 234 comprises information associated with one or more scales. This data may include one or more of key layout data 236, chord data 238, and so forth. The key layout data 236 assigns or otherwise associates a particular note 118 with a particular melody key 116 and a particular chord 120 with a particular chord key 114. The key layout data 236 may include other information, such as a color, graphic, text, or other information used to present a particular visual indicia 108. The chord data 238 comprises information indicative of the chords 120 and their constituent notes 118 that are available for that particular scale.

The scale data 234 may comprise key layout data 236 and chord data 238 for a plurality of different scales. For example, the scales may include B Phrygian, B Locrian, A Aeolian, D Dorian, and so forth. Due to the different notes 118 associated with these different scales, each presents different notes 118 for melody and different sets of chords 120.

The key control module 226 may be configured to receive input that is indicative of a particular scale. For example, the musician 102 may use the menu keys 110 to select the B Phrygian scale. Once selected, the key control module 226 accessed the scale data 234 and determines the key layout data 236 and the chord data 238 associated with the B Phrygian scale. The key layout data 236 assigns the various keys 106 different functions. The melody keys 116 are associated with the individual notes 118 defined by the particular scale. The chord keys 114 are associated with particular chords 120. The chord data 238 provides the information that indicates the constituent notes 118 for a particular chord 120. In some implementations the key layout data 236 may incorporate the chord data 238. For example, the constituent notes 118 for a particular chord 120 may be stored as key layout data 236.

The key control module 226 may maintain and otherwise utilize current note(s) playing current note playing (CNP) data 240. The CNP data 240 contains information indicative of the notes 118 for which note on data 124 has been issued and no subsequent note off data 126 has yet been issued. The CNP data 240 is indicative of notes 118 played individually, such as from activation of a melody key 116, as well as the notes 118 associated with activation of a chord key 114. In some implementations the CNP data 240 may include one or more of current melody key data 240(1), current chord key data 240(2), note data 240(3), and so forth. The current melody key data 240(1) provides information indicative of one or more of the particular melody keys 116 that have been pressed. The current chord key data 240(2) provides information indicative of one or more of the particular chord keys 114 that have been pressed. In some implementations the current chord key data 240(2) may be limited to storing data indicative of a single chord key 114. The note data 240(3) may comprise data indicative of the notes 118 that are playing, such as the notes 118 associated with a chord 120 that is assigned to a particular chord key 114, or individual notes 118 that are assigned to the melody keys 116 that are being played. Utilization of the CNP data 240 is discussed in more detail below with regards to FIGS. 3-6.

The key control module 226 may also maintain and otherwise utilize chord waiting data 242, in some implementations. The chord waiting data 242 may store information indicative of notes 118 associated with chords 120 that have been played as a result of input from a chord key 114, but have not yet been sent as output data 122. For example, the chord waiting data 242 is indicative of chords 120 waiting to be played. The chord waiting data 242 is discussed in more detail below with regard to FIG. 5.

In some situations there may be conflicting or contradictory situations as to whether to send note off data 126 for a particular note 118. For example, the note 118 may be included in a chord 120 that is currently playing responsive to a chord key 114 and also is being played by a melody key 116. The key control module 226 is configured to determine the press or release of keys 106 and then generate the output data 122. The output data 122 may then use the communication interface 208 to send the output data 122. Details of this operation are discussed in more detail below with regard to FIGS. 3-6.

The other modules 228 may also be present in the memory 218. For example, the other modules 228 may include MIDI rendering modules that interpret the output data 122 and produce audio output onboard the input device 104. In this way, the input device 104 may be used as a standalone electronic musical instrument.

Other data 244 may also be stored in the data store 222. For example, the other data 244 may include one or more threshold values. For example, the threshold values may specify a maximum number of chords 120 to hold within the chord waiting data 242, duration of time to hold a chord 120 within the chord waiting data 242, and so forth. Threshold values may also include maximum values, minimum values, ranges of values, and so forth.

Figure 3:
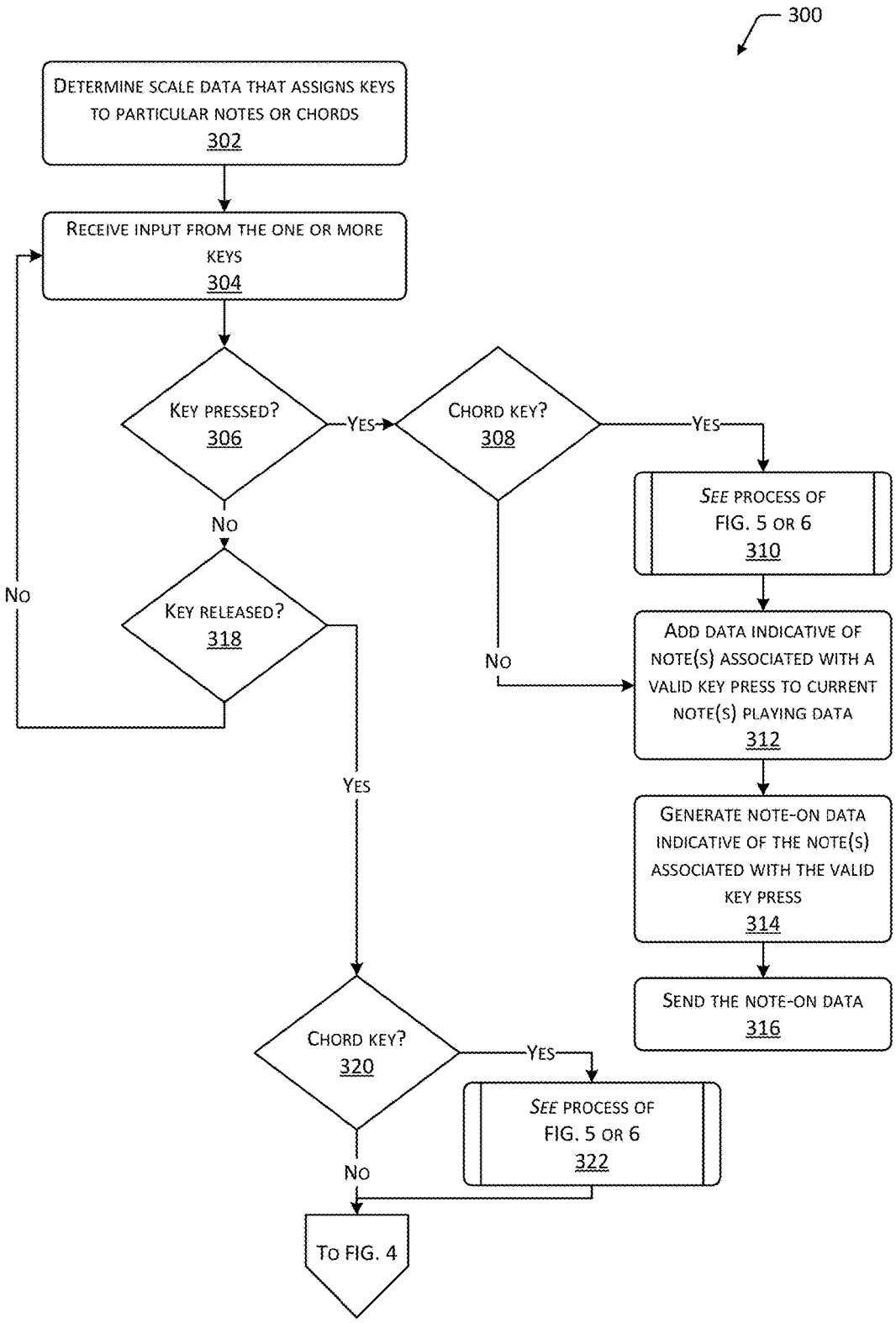
FIGS. 3 and 4 are flow diagrams of a process for generating output data, such as MIDI formatted commands, using the processed input, according to one implementation.
Figure 4:
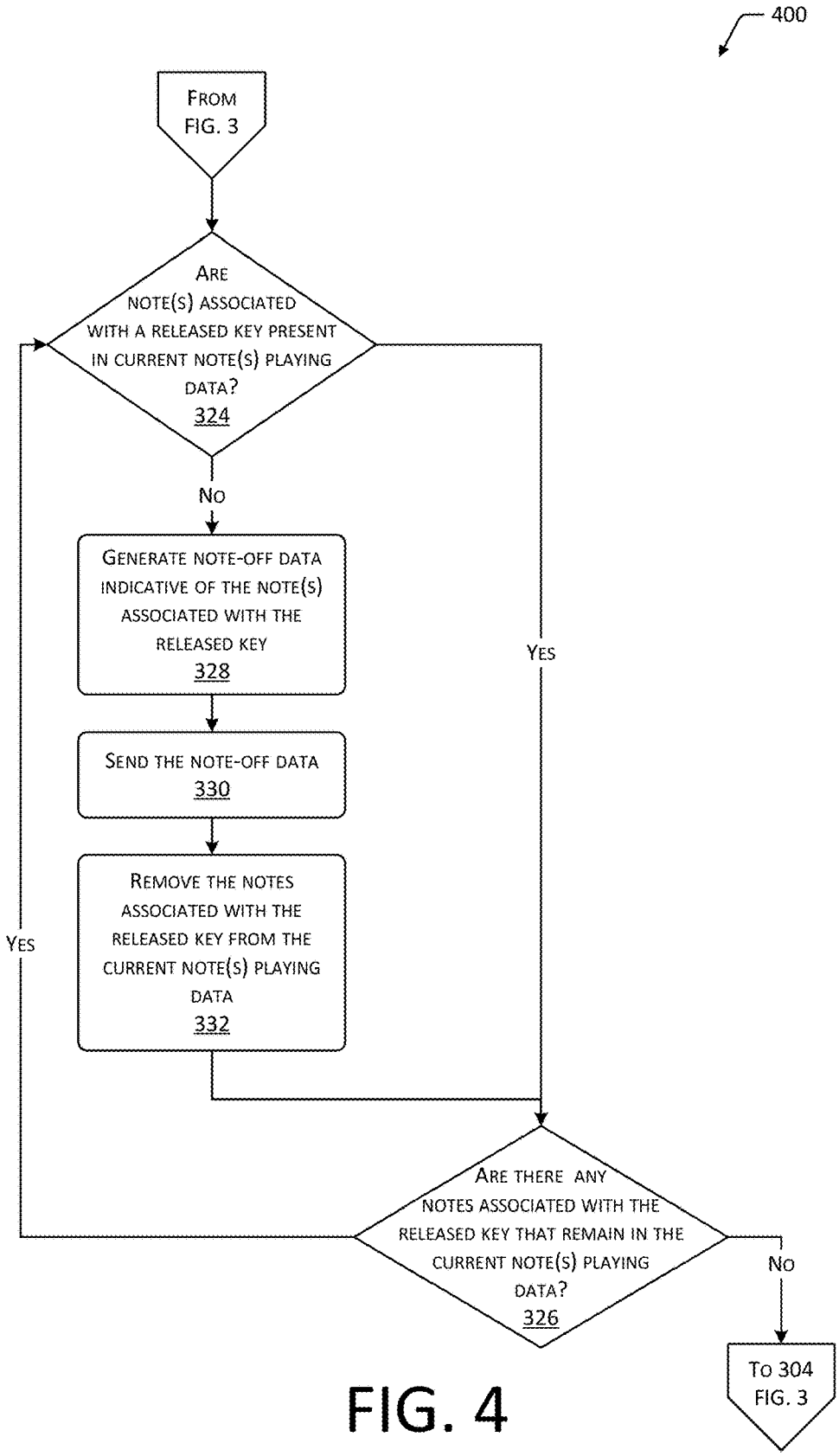

FIGS. 3 and 4 are flow diagrams 300 and 400 of a process for generating output data, such as MIDI formatted commands, using the processed input, according to one implementation. The process may be implemented using one or more of the input device 104, the computing device 128, or other devices.

At 302 scale data 234 that assigns keys 106 to particular notes 118 or chords 120 is determined. For example, the musician 102 uses the menu keys 110 to select a particular scale from a menu of available scales. Responsive to that selection, the scale data 234 associated with that particular scale is accessed. The key layout data 236 and chord data 238 are then used to associated particular notes 118 to melody keys 116, chords 120 to chord keys 114, set the visual indicia 108, configure the control keys 112, and so forth.

The processor 204 may perform the following operations. A specified scale comprises a plurality of designated musical notes 118. An $n^{th}$ key of the melody keys 116 is assigned to represent an $i^{th}$ note of the designated musical notes 118. For example, the key layout data 236 may specify this assignment. An $r^{th}$ color is associated with the $i^{th}$ note 118. The $n^{th}$ key is configured to present the $r^{th}$ color, providing the visual indicia 108. For example, the key layout data 236 may specify this association.

A $c^{th}$ chord is determined, comprising a plurality of notes 118 from the designated musical notes in the scale. A $j^{th}$ key of the chord keys 114 is assigned to represent the $c^{th}$ chord. For example, the key layout data 236 may specify this assignment. The constituent notes 118 of the $c^{th}$ chord may be specified in the chord data 238. The $j^{th}$ key is configured to present the $r^{th}$ color, providing the visual indicia 108. As used above, n, i, r, c, and j are representative of non-zero positive integer values. The process may continue until either all keys 106 are assigned or until all notes 118 and chords 120 for the particular scale are assigned to a key 106.

In some implementations one or more of the chords 120 may be inverted chords. For example, the $c^{th}$ chord assigned to the $j^{th}$ key may be an inverted chord.

At 304 input is received from the one or more keys 106. For example, the musician 102 may begin playing using the input device 104. The action of playing the input device 104 includes the musician 102 pressing and releasing, or otherwise activating and deactivating, one or more keys 106 or other controls. As described above, the output data 122 is provided to another device, that may record the output data 122, use the output data 122 to generate audible sounds, and so forth.

At 306 a determination is made as to whether a key 106 is pressed. For example, a key 106 may be deemed to be pressed when it transitions from an off state to an on state.

At 308 a determination is made as to whether the key 106 is a chord key 114.

Figure 5:
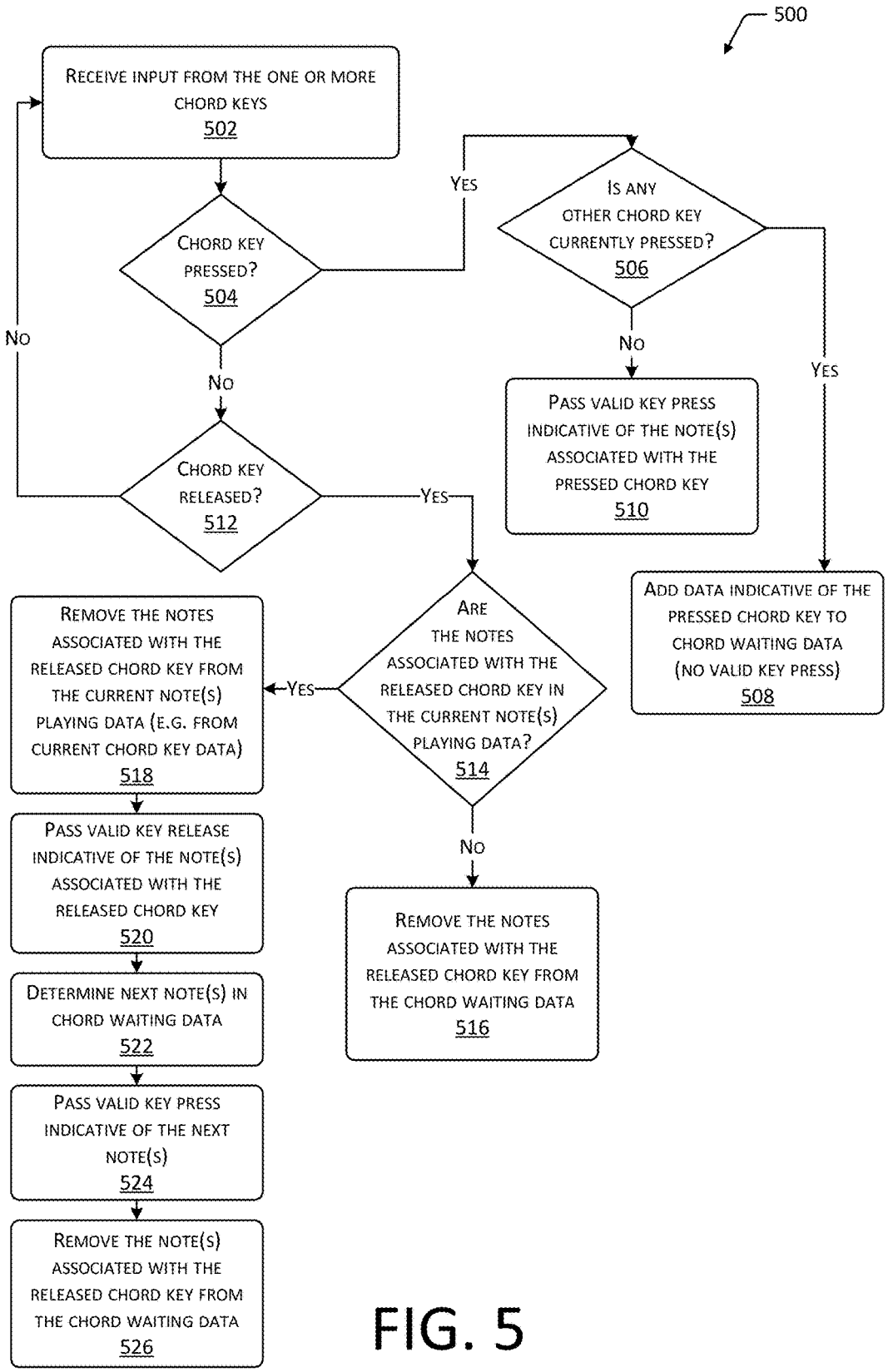
FIG. 5 is a flow diagram of a process for processing input, according to one implementation.
Figure 6:
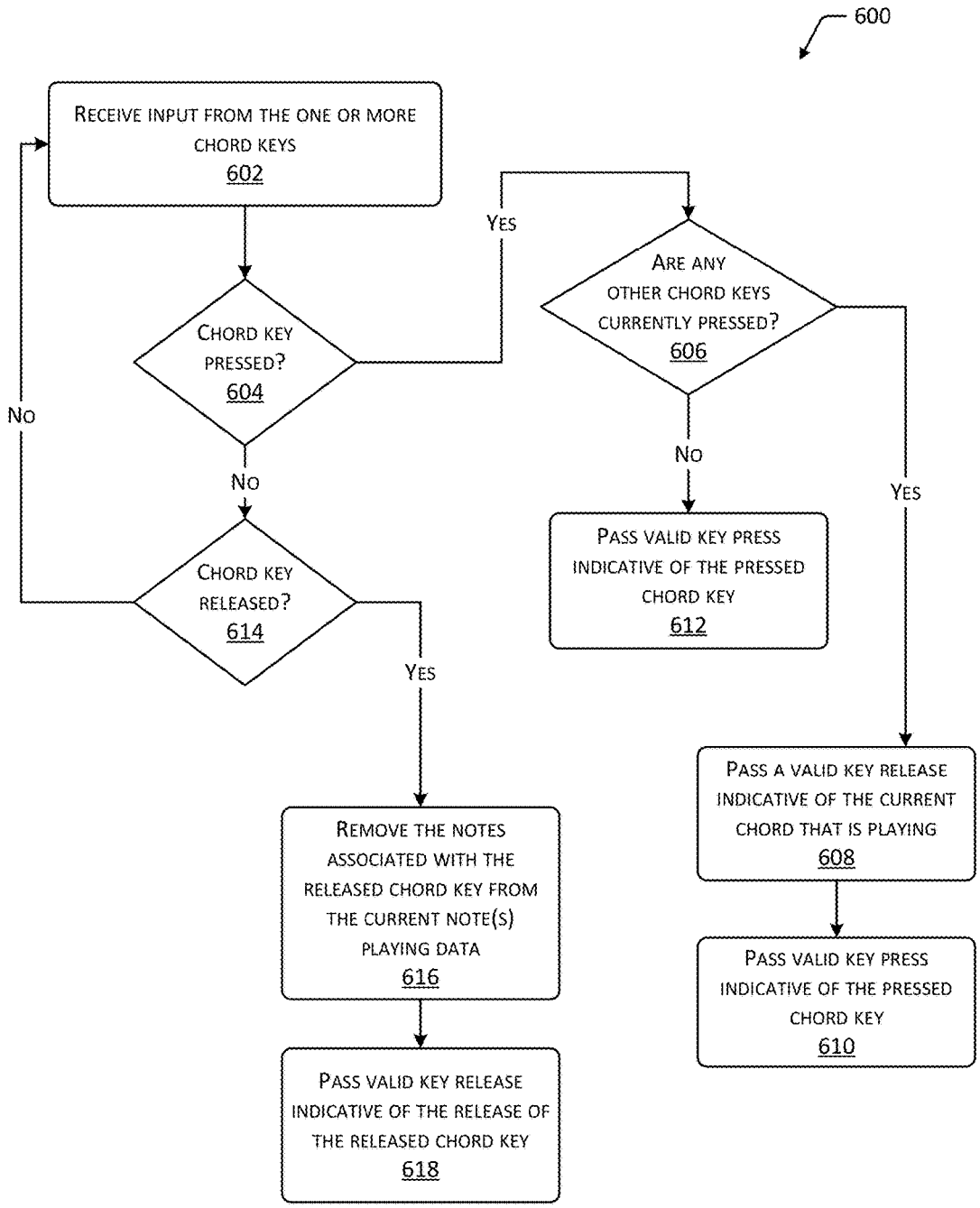
FIG. 6 is a flow diagram of a process for processing input, according to one implementation.

As depicted here, a determination of a key press 306 and that the key 106 is a chord key 114 results in the process proceeding to 310. At 310 one or more of the processes described below with regard to FIG. 5 or FIG. 6 may be utilized. In some implementations, these processes may be mutually exclusive such that either the process of FIG. 5 is used or the process of FIG. 6 is used, but not both. That process may then proceed to 312.

At 312, data indicative of one or more notes associated with a valid key press are added current note playing data 240. For example, data indicative of these keys may be added to the current chord key data 240(2).

At 314, note on data 124 is generated that is indicative of the one or more notes associated with the valid key press. For example, the note on data 124 may comprise a MIDI command.

At 316, the note on data 124 may be stored in memory 218, sent as output data 122 to an external device such as the computing device 128, and so forth.

Returning to 308, if the key 106 that is pressed is not a chord key 114 and instead is a melody key 116, the process may proceed to 312, bypassing 310.

Returning to 306, if no key 106 is pressed, the process may continue to 318 that determines if the input is indicative of release of a key 106. If the determination at 318 is such that the key 106 has been released, the process may proceed to 320 to determine if the released key 106 is a chord key 114. If yes, the process may proceed to 322. At 322 one or more of the processes described below with regard to FIG. 5 or FIG. 6 may be utilized. That process may then proceed to 324. If the determination at 320 is that the key 106 that is released is not a chord key 114 but is instead melody key 116, the process may proceed to 324, bypassing 322.

Returning to 318, if no key 106 is determined to be released, the process may proceed to 304.

FIG. 4 continues the depiction of the process begun at FIG. 3.

At 324 a determination is made as to whether one or more notes 118 associated with a released key 106 are present in current note(s) playing data 240. For example, if the key 106 is associated with chord keys 114, the determination may involve a search or comparison of the current chord key data 240(2). In another example, if the key 106 is associated with melody keys 116, the determination may involve a search or comparison of the current melody key data 240(1). If the determination is that there are notes 118 associated with the released key 106 present in the current notes playing data 240, the process may proceed to 326.

At 326, determination is made as to whether there are any notes associated with the released key 106 that remain in the current notes playing data 240. If there are not any notes 118 associated with the released key 106 that remain in the current notes playing data 240, the process may return to block 304, waiting for or receiving input from the one or more keys 106. If there are notes 118 associated with the released key 106 that remain in the current notes playing data 240, the process may return to 324.

At 324 if the notes associated with the released key are not present in the current notes playing data 240, the process may continue to 328. At 328, note off data 126 that is indicative of the notes 118 associated with the released key 106 is generated. For example, a MIDI command indicating note off may be generated.

At 330 the note off data 126 may be stored in memory 218, sent as output data 122, and so forth.

At 332, the notes 118 associated with the released key 106 are removed from the current notes playing data 240. For example, the released key 106 comprises a chord key 114, data indicative of that chord key 114 or the notes 118 associated there with may be removed from the current chord key data 240(2). As used in this disclosure, operations such as adding or removing data to or from a data structure are provided by way of illustration and not necessarily as a limitation. It is understood that other equivalent operations may be utilized. For example, instead of adding or removing data, a flag may be flipped.

FIG. 5 is a flow diagram of a process 500 for processing input, according to one implementation. The process may be implemented using one or more of the input device 104, the computing device 128, or other devices.

At 502, input is received from one or more of the chord keys 114.

At 504 a determination is made as to whether a chord key 114 has been pressed. If a chord key 114 has been pressed, the process may proceed to 506. At 506 a determination is made as to whether any other chord key 114 is currently pressed. Data indicative of the key press may be passed to a later process or portion thereof. If yes, the process may proceed to 508. At 508, data indicative of the pressed chord key 114 is added to the chord waiting data 242. At this point, no valid key press has been determined.

Returning to 506, if there is no other chord key 114 that is currently pressed, the process may proceed to 510. At 510, data indicative of a valid key press is passed. This data may be indicative of one or more of the notes associated with the pressed chord key 114, a designator for the specific chord key 114, and so forth. Data indicative of the key press may be passed to a later process or portion thereof.

Returning to 504, if no chord key 114 is determined to be pressed, the process may proceed to 512. At 512, a determination is made as to whether a chord key 114 has been released. If not, the process may return to 502. If a chord key 114 has been released the process may continue to 514.

At 514 determination is made as to whether the notes 118 associated with the released chord key 114 are in the current notes playing data 240. For example, a designator indicative of a particular chord key 114 may be compared to the current chord key data 240(2).

If the notes 118 associated with the released chord key 114 are not indicated within the current notes playing data 240, process proceeds to 516. At 516 the notes 118 associated with the released chord key 114 are removed from the chord waiting data 242. For example, a designator indicative of a particular chord key 114 may be removed from the chord waiting data 242.

Returning to 514, if the notes associate with the released chord key 114 are present in the current notes playing data 240, process may proceed to 518. At 518, the notes associated with released chord key 114 are removed from the current notes playing data 240. For example, data indicative of the particular chord key 114 may be removed from current chord key data 240(2).

At 520 a valid key release is determined that is indicative of the notes associated with the released chord key 114.

At 522 the next note(s) 118 in the chord waiting data 242 are determined. For example, the chord waiting data 242 may comprise a stack and the next notes may comprise the next notes to be retrieved from the stack that are associated with a chord 120.

At 524 a valid key press is determined that is indicative of the notes associated with the next notes.

At 526 the notes 118 associated with the released chord key 114 are removed from the chord waiting data 242. For example, the chord associated with valid key press has been expressed in terms of a note on data 124 that is been sent to the computing device 128. Now that those notes have been sent, they may be deemed to be played and are thus removed from the chord waiting data 242 to prevent duplication.

FIG. 6 is a flow diagram of a process 600 for processing input, according to one implementation. The process may be implemented using one or more of the input device 104, the computing device 128, or other devices.

At 602, input is received from one or more of the chord keys 114.

At 604 a determination is made as to whether a chord key 114 has been pressed. If a chord key 114 has been pressed, the process may proceed to 606. At 606 a determination is made as to whether any other chord key 114 is currently pressed. The current note(s) playing data 240 may be used to determine that a current chord is playing. For example, the current chord key data 240(2) searched for the currently pressed chord key 114.

At 608, valid key release is determined that is indicative of the current chord 120 that is playing. Data indicative of the key release may be passed to a later process or portion thereof.

At 610 a valid key press indicative of the pressed chord key 114 is determined. Data indicative of the key press may be passed to a later process or portion thereof. With this implementation, pressing another chord key 114 stops a previous chord key 114 from being played. In other implementations, the process may be modified to allow for multiple chords 120 to be simultaneously played.

Returning to 606, if there is no other chord key 114 that is currently pressed, the process may proceed to 612. At 612, data indicative of a valid key press is passed. This data may be indicative of one or more of the notes 118 associated with the pressed chord key 114, a designator for the specific chord key 114, and so forth. Data indicative of the key press may be passed to a later process or portion thereof.

Returning to 604, if no chord key 114 is determined to be pressed, the process may proceed to 614. At 614, a determination is made as to whether a chord key 114 has been released. If not, the process may return to 602. If a chord key 114 has been released the process may continue to 616.

At 616, the notes 118 associated with released chord key 114 are removed from the current notes playing data 240. For example, data indicative of the particular chord key 114 may be removed from current chord key data 240(2).

At 618 a valid key release is determined that is indicative of the notes associated with the released chord key 114. This data may be indicative of one or more of the notes 118 associated with the released chord key 114, a designator for the specific chord key 114, and so forth. Data indicative of the key release may be passed to a later process or portion thereof.

One or more of the functions as described above with regards to FIGS. 3-6 this may be performed using one or more of the processor 204 of the input device 104, the computing device 128, or another device. For example, the input device 104 may send raw output data 122 comprising information indicative of the state of keys 106, or changes in state of the keys 106, to another device that generates the output data 122.

Figure 7:
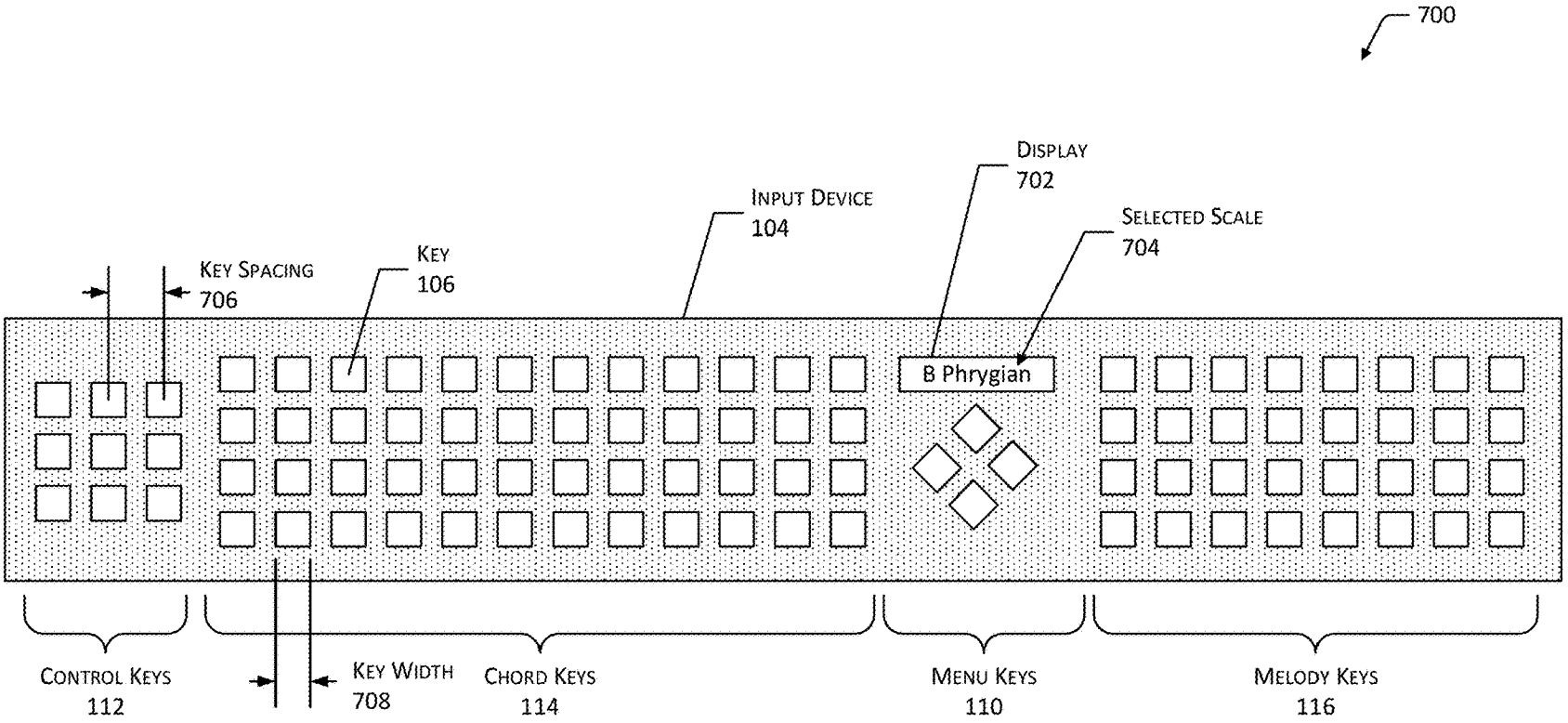
FIG. 7 depicts a layout of the input device, according to one implementation.

FIG. 7 depicts a layout 700 of the input device 104, according to one implementation. The input device 104 may include a display 702. The display 702 may be used to present information such as a selected scale 704. In this illustration, the display 702 shows that the musician 102 has selected the B Phrygian scale. The menu keys 110 may be used to select a different scale from those that are available. The display 702 may also be used to display other information, such as a current note 118 or chord 120 that is playing.

The keys 106 may have a key spacing 706 that provides suitable physical separation to minimize inadvertent key actuation while also providing ready accessibility to the musician 102. For example, the key spacing 706 may be between 18 and 30 millimeters from center to center. In one implementation, the key spacing 706 may be 20 mm from center to center of adjacent keys 106. Key width 708 may be between 10 and 25 mm. For example, the key width 708 may be 22 mm.

The keys 106 may be arranged in various layouts. In the layout depicted here, there are 48 chord keys 114 that are arranged in arranged in four rows of twelve keys 106. There are 32 melody keys 116 arranged in four rows of eight keys 106. During operation, depending upon the selected scale 704, some of the keys 106 may be unassigned. For example, the B Phrygian scale only utilizes 28 notes 118. As a result, four melody keys 116 are unassigned. The chord keys 114 or the melody keys 116 may have different numbers of rows or columns, may include fewer or greater numbers of keys 106, and so forth. In other implementations, other layouts of the keys 106 may be used. For example, the chord keys 114 and the melody keys 116 may be arranged in concentric arc. In some implementations, the chord keys 114 may be arranged on the right of the input device 104 while the melody keys 116 are arranged on the left of the input device 104.

When present, the menu keys 110 and the control keys 112 may be arranged in other ways as well, or in other locations with respect to the input device 104. For example, the control keys 112 may be arranged in a row rather than a square grid arrangement is depicted here.

Attributes such as the key spacing 706, key width 708, and so forth may vary between different keys 106 within a group of keys 106, or from one group of keys 106 to another. For example the chord keys 114 may have a smaller key spacing 706 and smaller key width 708 than the melody keys 116, allowing more chord keys 114 to be placed in a smaller area.

Figure 8:
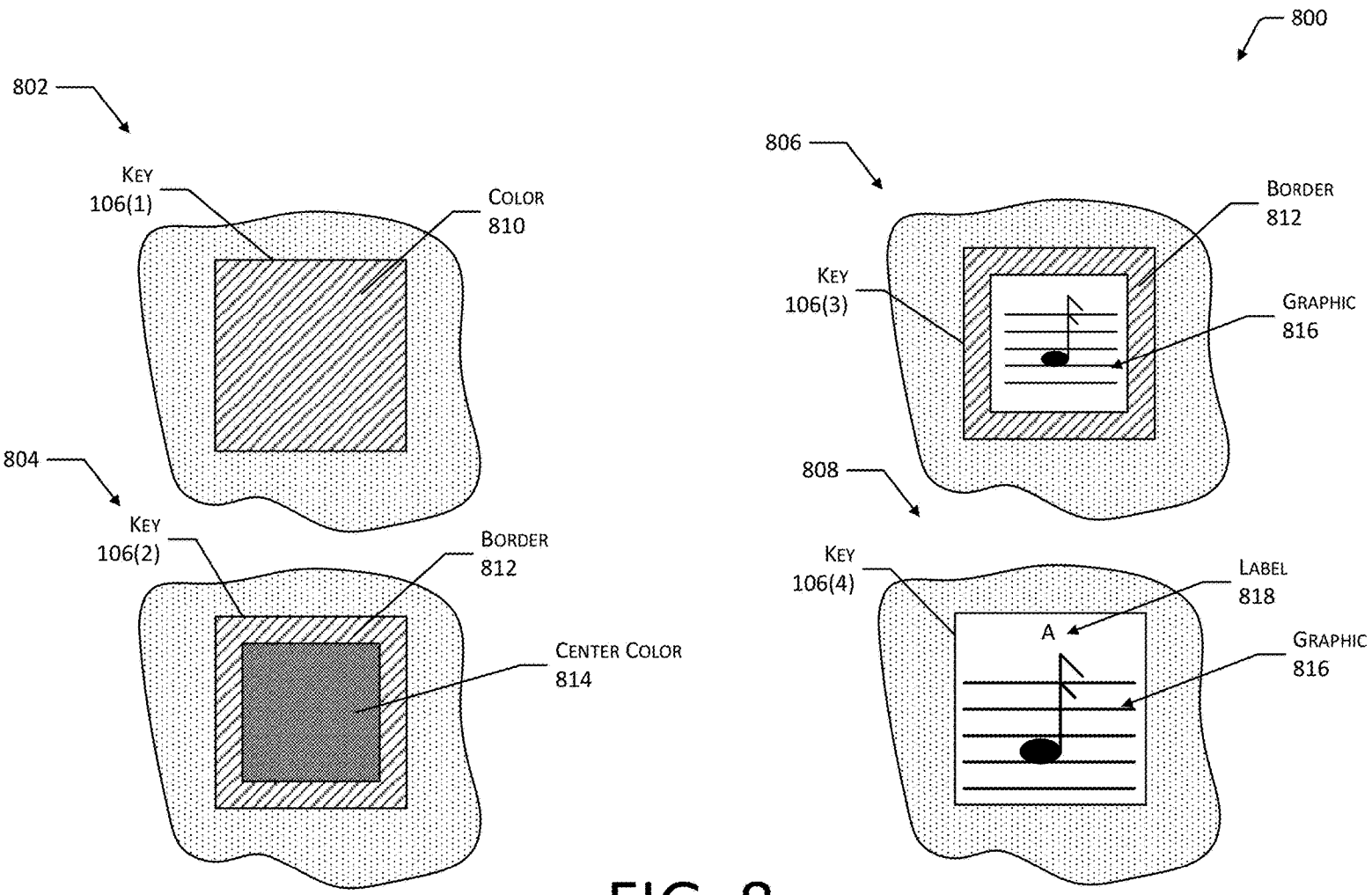
FIG. 8 depicts different visual indicia that may be presented by the input device, according to one implementation.

FIG. 8 depicts enlargements 800 of different visual indicia 108 that may be presented by the input device 104, according to one implementation. As described above, the visual indicia 108 are produced by one or more visual indicators 216. For example, the visual indicators 216 may be light emitting diodes (LED), quantum dots, electroluminescent elements, electrophoretic elements, cholesteric elements, optically interferometric elements, and so forth. The visual indicators 216 may be emissive, in that they emit photons, or they may be reflective in that they reflect ambient light. For example, an LED is an emissive visual indicator 216. In comparison, liquid crystal, electrophoretic, cholesteric, and optically interferometric devices interact with ambient light to produce a visual effect.

The visual indicators 216 may be able to produce illumination of a particular color, change the apparent color, and so forth. Some visual indicators 216 may be poly chromatic while others may be monochromatic. For example, a multicolor LED may be able to produce red, green, blue, and is thus designated as polychromatic. In comparison, a reflective liquid crystal element or electrophoretic element may be monochromatic in that it presents the visual indicia 108 with one or more shades of a single color.

The visual indicators 216 may comprise segmented displays, pixelated displays, and so forth. For example, a segmented display such as a liquid crystal display may utilize predefined segments that may be selectively activated to produce a particular image. Continuing the example, the segment display may be configured to provide a rendering of a musical staff and notes 118 at one or more locations on that staff. In another example, pixelated display may comprise rows and columns of pixels that may be addressed either individually or in subgroups such that a particular image may be produced.

Depicted are first 802, second 804, third 806, and fourth 808 implementations. These implementations may utilize one or more of emissive or reflective visual indicators 216. The first implementation 802 depicts a key 106(1) in which a portion of the key 106 that is proximate to the musician 102 during use presents a particular color 810. For example, a transparent or translucent key cap of the key 106 may be illuminated by a red LED.

The second implementation 804 depicts a key 106(2) which includes a border 812 that surrounds a center color 814 with one or more of a different color or pattern. For example, the center color 814 may be green while the border 812 is blue. In one implementation, the center color 814 may be associated with a particular root note 118 while the border 812 is associated with some other characteristics such as a particular designation of a chord progression, or vice versa. In this way, the musician 102 may be able to not only determine the root note 118 of a particular key 106, but will also be able to determine other information such as the particular type of chord 120. In other implementations, other sections of the key 106(1) may be illuminated with different colors. For example, a left half may be red and a right half blue.

The third implementation 806 depicts a key 106(3) that includes a border 812 surrounding a graphic 816. The graphic 816 provides a visual representation such as an image, diagram, and so forth. As depicted here, the graphic 816 comprises a portion of a musical staff. In other implementations, other graphics could be presented.

The fourth implementation 808 depicts a key 106(4) that presents a graphic 816 and a label 818. The label 818 may comprise text or other symbology that may be used by the musician 102 to provide an indication as to the function assigned to the key 106(4). In other implementations, other graphics 816 could be presented.

The various implementations described above are provided by way of illustration and not necessarily as a limitation. It is understood that various combinations of these and other visual indicia 108 may be utilized. For example, the first implementation 802 may include a label 818.

In some implementations, a key 106 may utilize a combination of different visual indicators 216. For example, an LED may be used to provide colored illumination while a liquid crystal display presents a graphic 816, label 818, or other image.

In some implementations, different types of visual indicators 216 may be used by different keys 106 of the input device 104. For example, the chord keys 114 and the melody keys 116 may utilize an LED to illuminate the key 106 while the menu keys 110 and the control keys 112 may utilize a display to present one or more of graphics 816, labels 818, and so forth.

Instead of, or in addition to, the use of visual indicia 108, tactile or haptic indicia may be provided. The key 106 may be able to provide tactile output that allows the musician 102 to differentiate between keys 106 on the basis of touch. The key 106 may comprise an electroactive polymer, piezoelectric crystal, micro-electromechanical system, or other device that allows for the shape or texture of a portion of the key 106 to be changed. In another implementation, the key 106 may remain the same, but utilize an electrical signal to stimulate the nerves of the musicians 102 finger to produce a particular haptic sensation. By varying the actual or apparent tactile response, the musician 102 it is able to distinguish between different keys 106. For example, the key 106 assigned to B may be smooth, the key 106 assigned to C may be rough, the key 106 assigned to D may be ridged, and so forth.

In some implementations, such as those in which the key 106 is generated electronically, the shape of the key 106 may be used to distinguish. For example, the keys 106 associated with a B may be triangular, the keys 106 associated with a C may be square, and so forth.

In some implementations, the color, shape, texture, or both of the keys 106 may be manually configured. For example, the input device 104 may be associated with a particular scale, and key caps having a particular color, texture, and so forth may be manually emplaced at particular positions on the input device 104.

Figure 9:
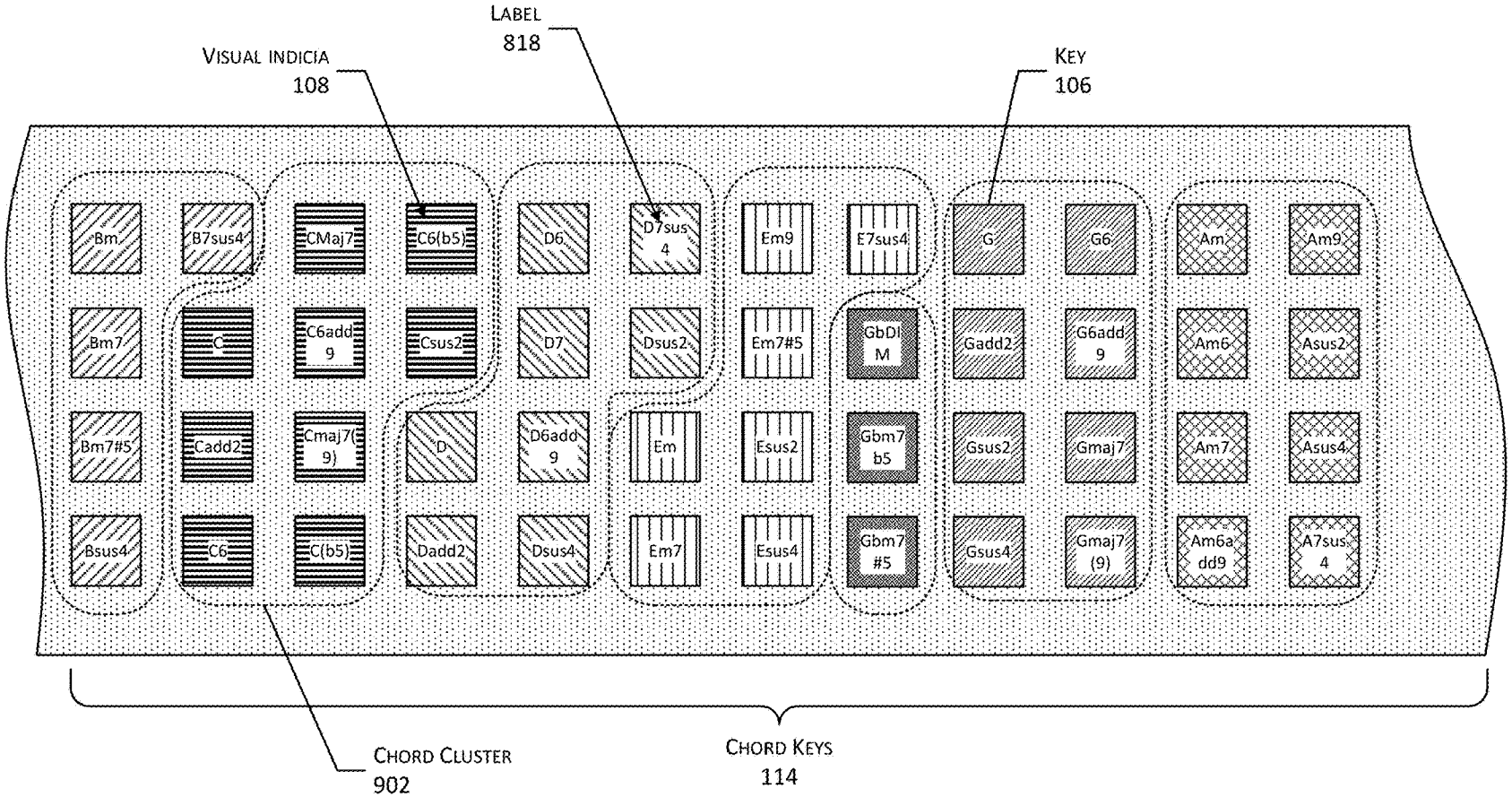
FIG. 9 depicts an enlarged view of the chord keys with visual indicia appropriate to a selection of a B Phrygian scale, according to one implementation.

FIG. 9 depicts an enlarged view 900 of the chord keys 114 with visual indicia 108 appropriate to a selection of a B Phrygian scale, according to one implementation. In this illustration, different colors 810 of the visual indicia 108 are represented by different crosshatch patterns. The labels 818 provide information about the particular chord 120 that is associated with a particular key 106 within the group of chord keys 114. A grouping of keys 106 that are associated with a particular base note 118 may be designated as a chord cluster 902. For example, the chord cluster 902 associated with the root note of C includes nine chords 120 represented by nine respective keys 106. The keys 106 within the same chord cluster 902 may utilize the same visual indicia 108. For example, the keys 106 within the chord cluster 902 for the root note of C may be colored orange and each presenting a different label 818 indicative of that particular chord 120.

The chords 120 represented by the chord keys 114 may be arranged in various sequences. For example, the chord keys 114 may be assigned chords 120 that increase from bottom to top in each column, progressing from left to right. In another example the chord keys 114 may be assigned chords 120 in a serpentine layout, such that chords 120 increase from bottom to top in a first column, then from top to bottom in an adjacent second column, and so forth. Other arrangements may also be used as well.

Depending upon the scale selected 704, the number of chords 120 associated with a particular root note 118 may vary. For example, the chord cluster 902 for the Gb root note 118 only comprises three chords 120, while the C root note 118 as described above includes nine.

In other implementations, other layouts of chord clusters 902 and their associated chords 120 may be utilized. For example, each column of keys 106 within the chord keys 114 may be designated to a different root note 118. To fit within the number of keys 106 in that column, some chords 120 may be omitted.

Figure 10:
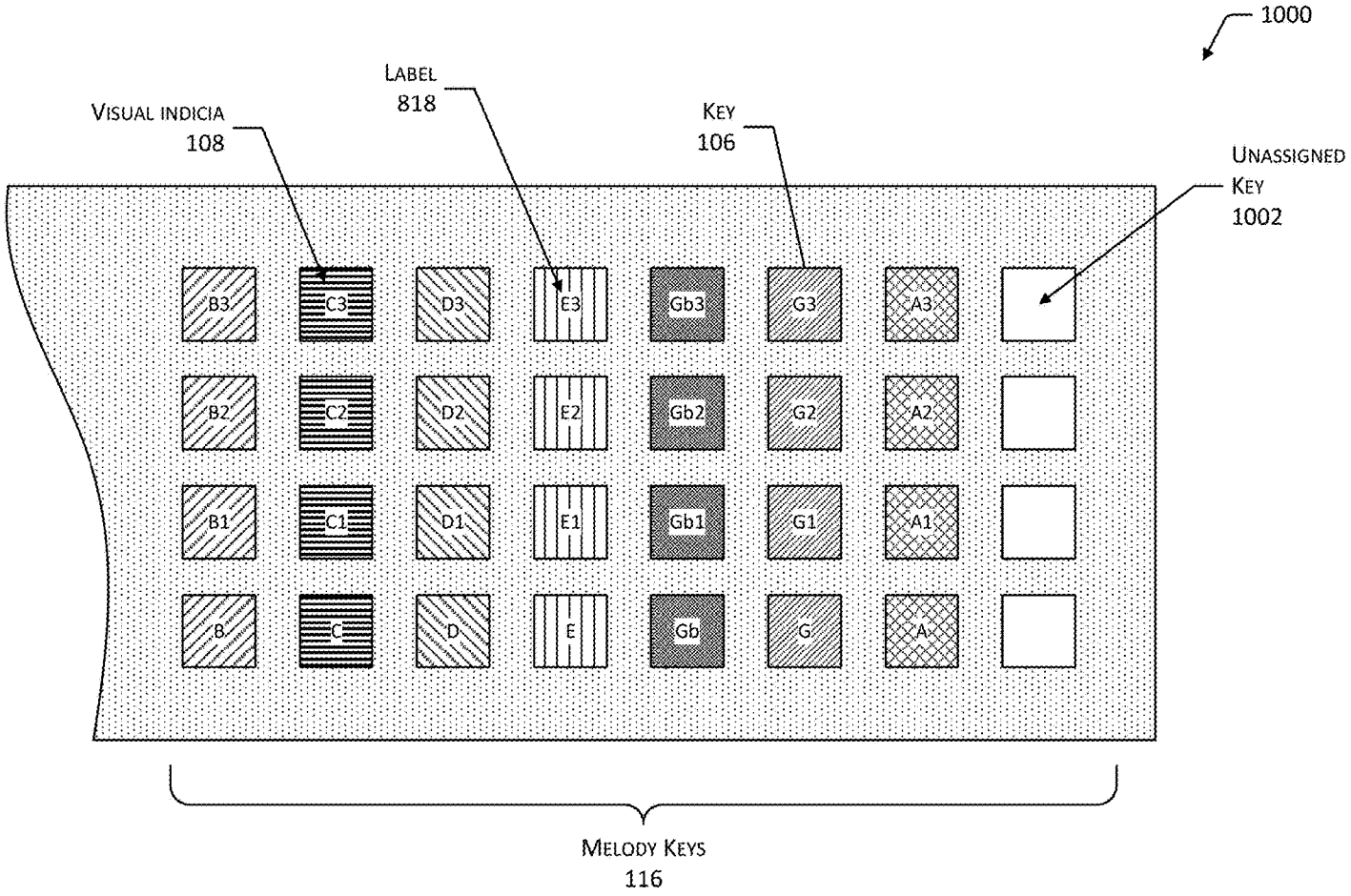
FIG. 10 depicts an enlarged view of the melody keys with visual indicia appropriate to a selection of a B Phrygian scale, according to one implementation.

FIG. 10 depicts an enlarged view 1000 of the melody keys 116 with visual indicia 108 appropriate to a selection of a B Phrygian scale, according to one implementation. In this illustration, different colors 810 of the visual indicia 108 are represented by different crosshatch patterns. For the sake of illustration, not necessarily as a limitation, the crosshatching is consistent from FIG. 10 to FIG. 9. For example, the crosshatching used to indicate the color 810 of the melody keys 116 associated with C in this illustration is the same crosshatching used to indicate those chords 120 having a root note of C in FIG. 9. The labels 818 provide information about the particular note 118 that is associated with a particular key 106 within the group of melody keys 116.

In this implementation, each column is associated with a different note 118, while each row of that column designates a different octave of the note 118. The notes 118 in the scale thus progress from lowest to highest in a left-to-right arrangement.

Some scales utilize fewer notes 118 than others. As a result, in some situations based on the selection of the particular scale, some keys 106 may be unassigned. For example, with the B Phrygian scale depicted in this illustration, the eighth column of keys 106 remain as unassigned keys 1002. In some implementations, the unassigned keys 1002 may be designated to perform other functions.

Because the assignment of a particular note 118 or chord 120 to a particular key 106 may vary with the selection of scale 704, the use of consistent visual indicia 108 between the chord keys 114 and the melody keys 116 aids the musician 102 in playing. For example, the musician 102 is readily able to determine if a root note 118 of a particular chord key 114 corresponds to a melody key 116.

Figure 11:
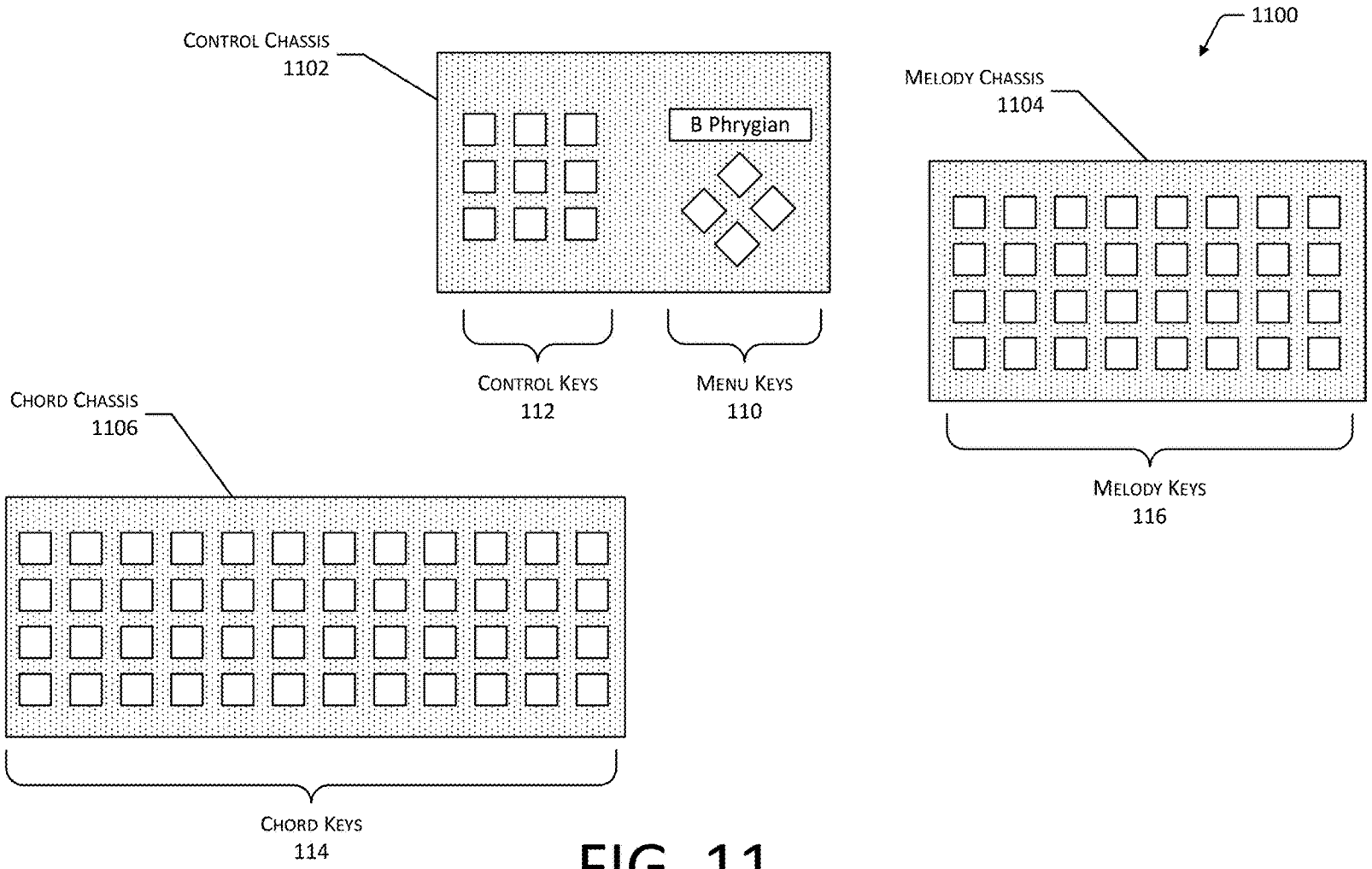
FIG. 11 depicts another configuration of the keys utilizing separate modules, according to one implementation.

FIG. 11 depicts another configuration 1100 of the keys utilizing separate modules, according to one implementation. The various groupings of keys 106 need not be associated with a single chassis. A control chassis 1102 is depicted that includes the menu keys 110 and the control keys 112. A melody chassis 1104 includes the melody keys 116, while a chord chassis 1106 includes the chord keys 114. In other implementations, other configurations may be utilized. For example, the chord chassis 1106 may include the control keys 112. By utilizing separate chassis the musician 102 is able to add functionalities as they see fit, improve the ergonomics of play, and so forth. For example, the musician 102 may utilize two of the chord chassis 1106 units to provide expansion for additional chords 120. Each chassis may include a communication interface 208 that allows for communication with one or more of the other chassis or the computing device 128.

Figure 12:
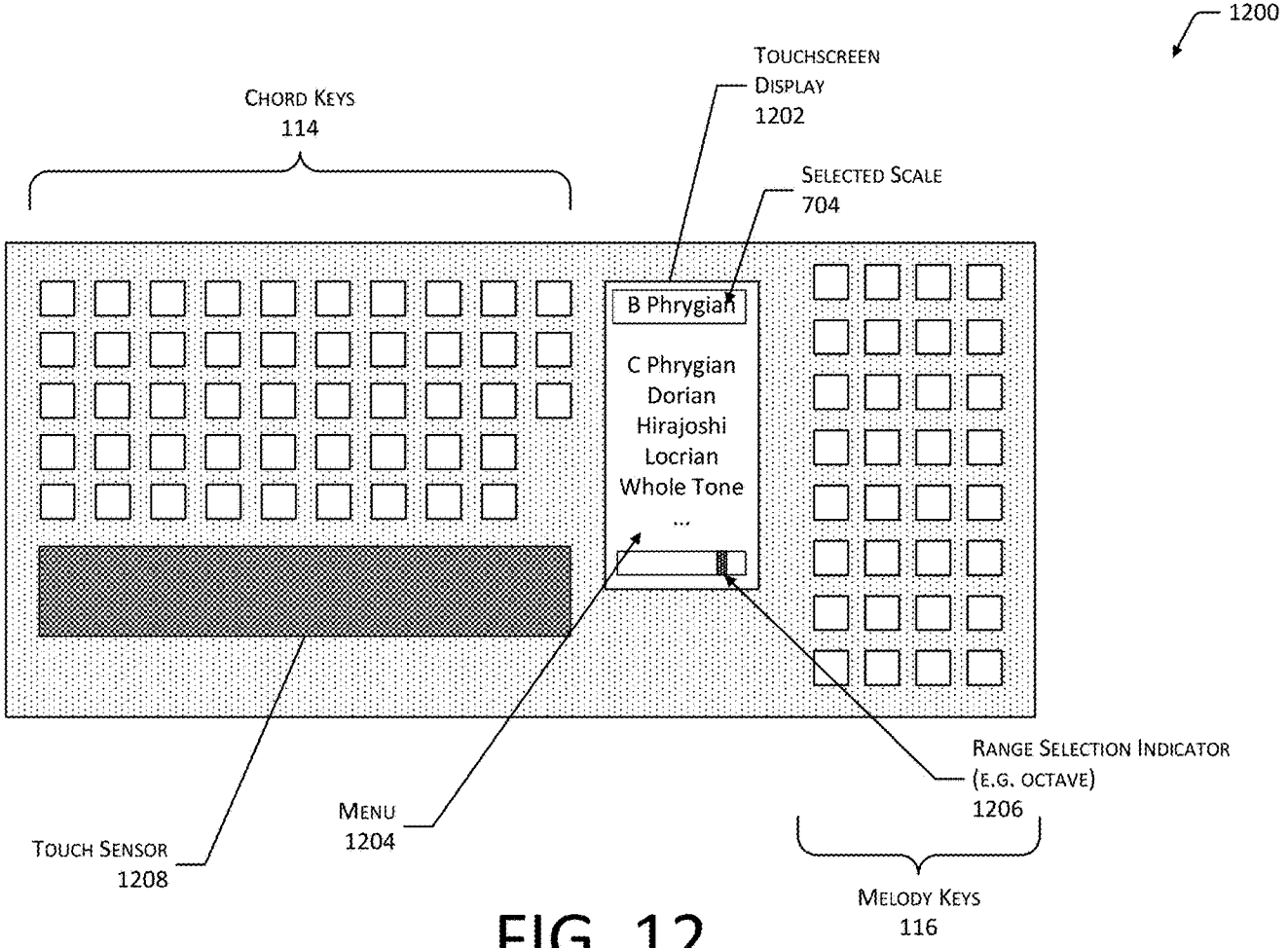
FIG. 12 depicts another configuration of the input device, according to one implementation.

FIG. 12 depicts another configuration 1200 of the input device 104, according to one implementation. In this implementation, the input device 104 utilizes a touchscreen display 1202. The touchscreen display 1202 presents a menu 1204 from which the musician 102 has selected a particular selected scale 704. Other information may also be presented on the touch screen display 1202. For example, a range selection indicator 1206 indicates the current setting as to which octave is in use.

Also depicted as a touch sensor 1208. The touch sensor 1208 may provide additional input that may be used to control operation of the input device 104. For example, the touch sensor 1208 may comprise a one-dimensional touch sensor or linear touch sensor may be used to set the octave of the input device 104. Continuing the example, the musician 102 may touch the leftmost side of the touch sensor 1208 to select the lowest available octave or touch the rightmost side of the touch sensor 1208 to select the highest available octave.

Figure 13:
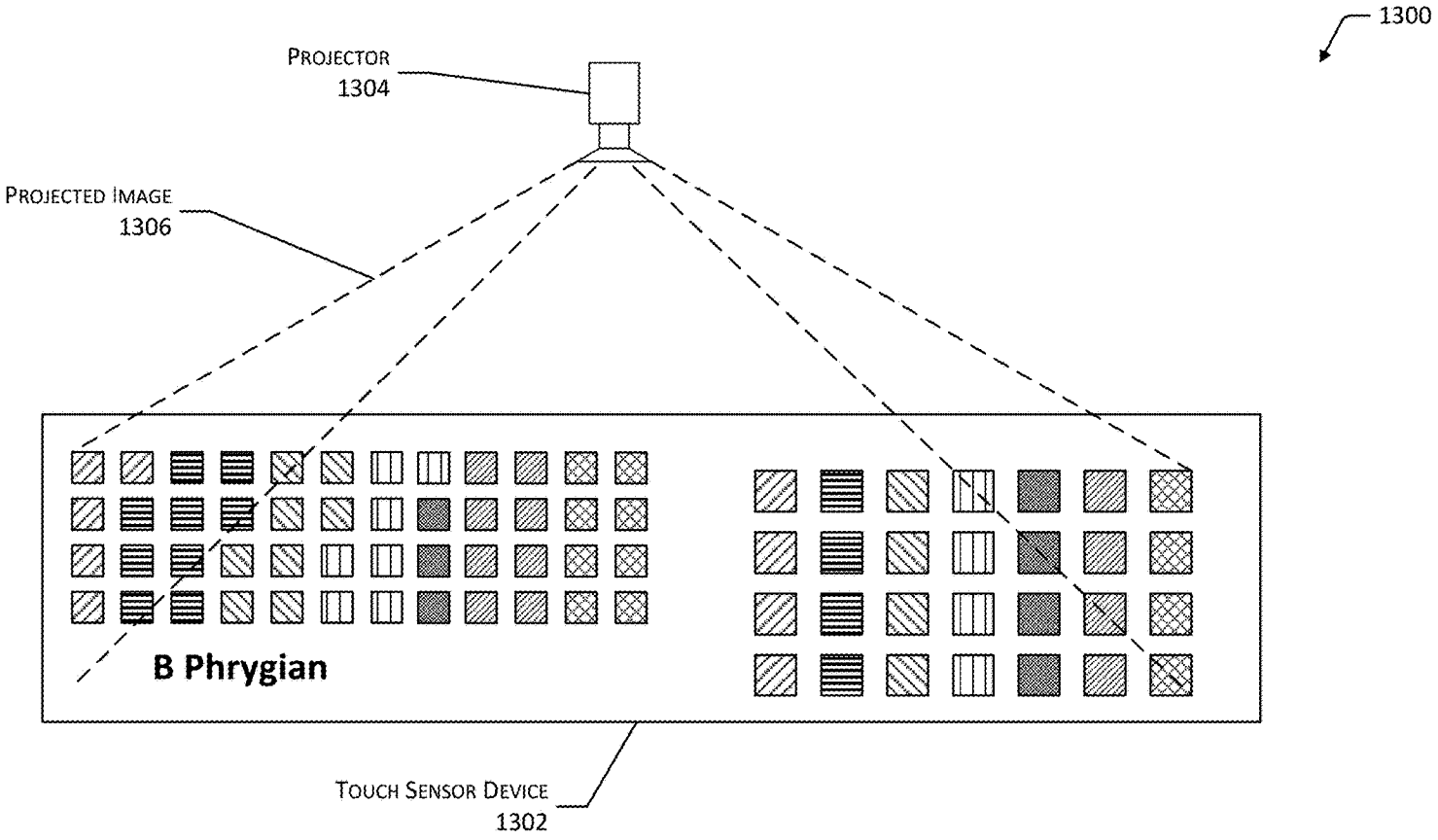
FIG. 13 depicts an input device using a projection of an image, according to one implementation.

FIG. 13 is a depiction 1300 of an input device that utilizes using a projection of an image, according to one implementation. In this implementation, touch sensor device 1302 such as a touch sensitive mat or sensor array is configured to generate input indicative of a touch by the musician 102 at particular points on the touch sensor device 1302. For example, the touch sensor device 1302 may comprise one or more of a capacitive touch sensor, resistive touch sensor, a force sensing resistor, an optical touch sensor, and so forth. A display device such as a projector 1304 provides a projected image 1306 onto a surface of the touch sensor device 1302. With this implementation, the individual keys 106 are virtual in that they have no discrete physical manifestation. As the musician 102 plays, their fingers touch the touch sensor device 1302 at different locations. Touch sensor device 1302 provides output indicative of these locations which may then be associated with a particular one of the keys 106 as projected onto the touch sensor device 1302.

As described above, attributes such as the key spacing 706, key width 708, and so forth may vary between different keys 106 within a group of keys 106, or from one group of keys 106 to another. For example the chord keys 114 may have a smaller key width 708 that the melody keys 116.

In some implementations, the touch sensor device 1302 may be omitted. For example, a camera may acquire an image of at least a portion of the projected image 1306 and determine a position of the fingers of the musician 102. Other techniques and devices may be used to determine the location of the fingers with respect to the projected image 1306, or portions thereof.

In another implementation, other display devices may be used to provide the projected image 1306. For example, the display device may comprise a head mounted display device. The keys 106 of the input device 104 may be virtual, with the input device 104 comprising an electronic representation that has no physical hardware. Instead, using one or more of augmented reality or virtual reality the input device 104 and its corresponding keys 106 may appear to be present to the musician 102. The musician 102 may then play this virtual representation of the input device 104.

Figure 14:
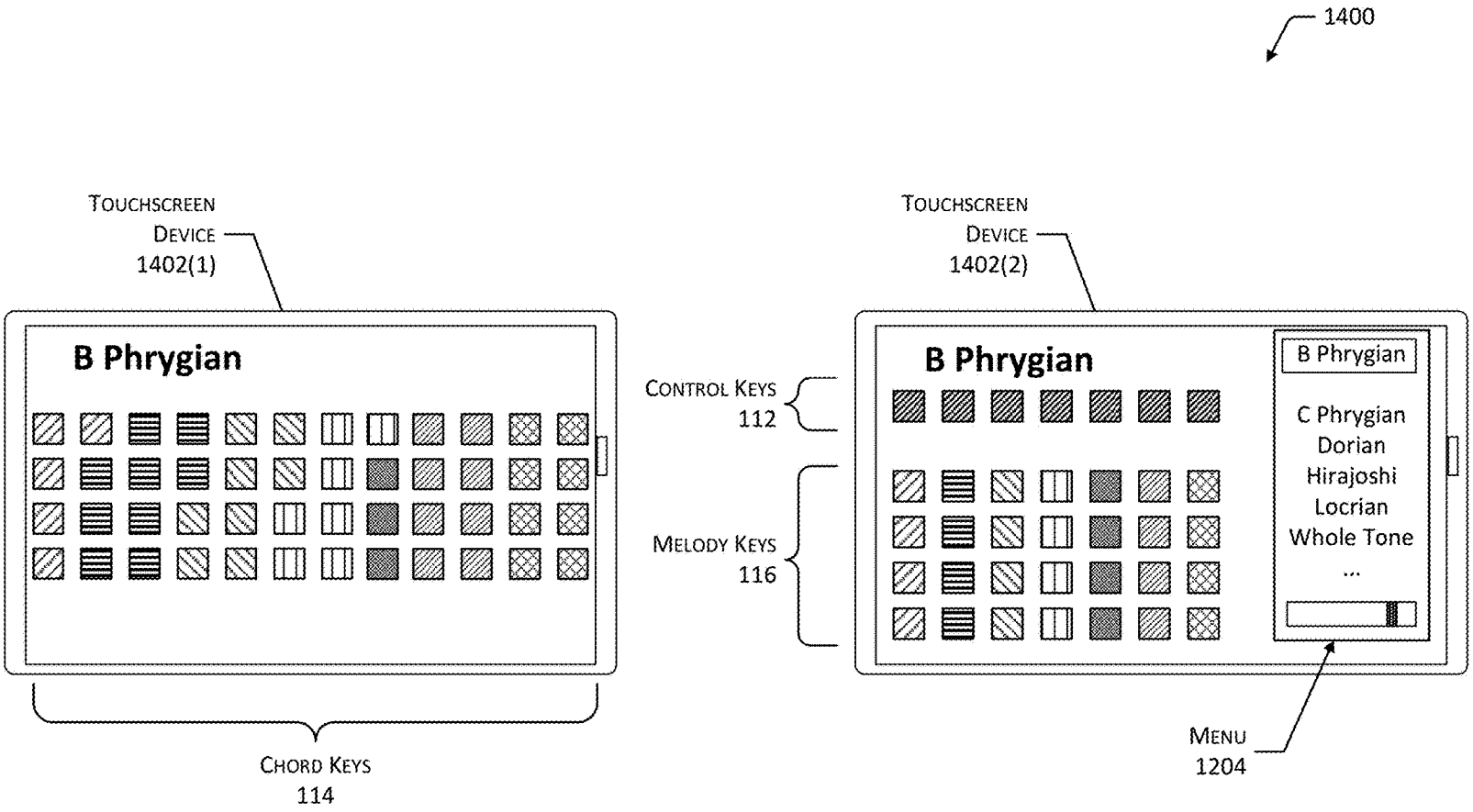
FIG. 14 depicts utilization of touchscreen devices as input devices, according to one implementation.

FIG. 14 depicts utilization of touchscreen devices as input devices 104, according to one implementation. In this implementation, one or more touchscreen devices 1402 are utilized to act as display devices that present the keys 106 and their associated visual indicia 108 as described above. The touchscreen devices 1402 may comprise a tablet, computers, smart phones, touchscreen monitors, and so forth. The touchscreen devices 1402 may be of the same or different form factors. For example, one touchscreen device 1402 may comprise a tablet computer while another touchscreen device 1402 comprises a smart phone.

In this illustration, two touchscreen devices 1402(1) and 1402(2) are depicted. The touchscreen device 1402(1) is present in the chord keys 114 while the touchscreen device 1402(2) is presenting the control keys 112, the melody keys 116, and the menu 1204.

Figure 15:
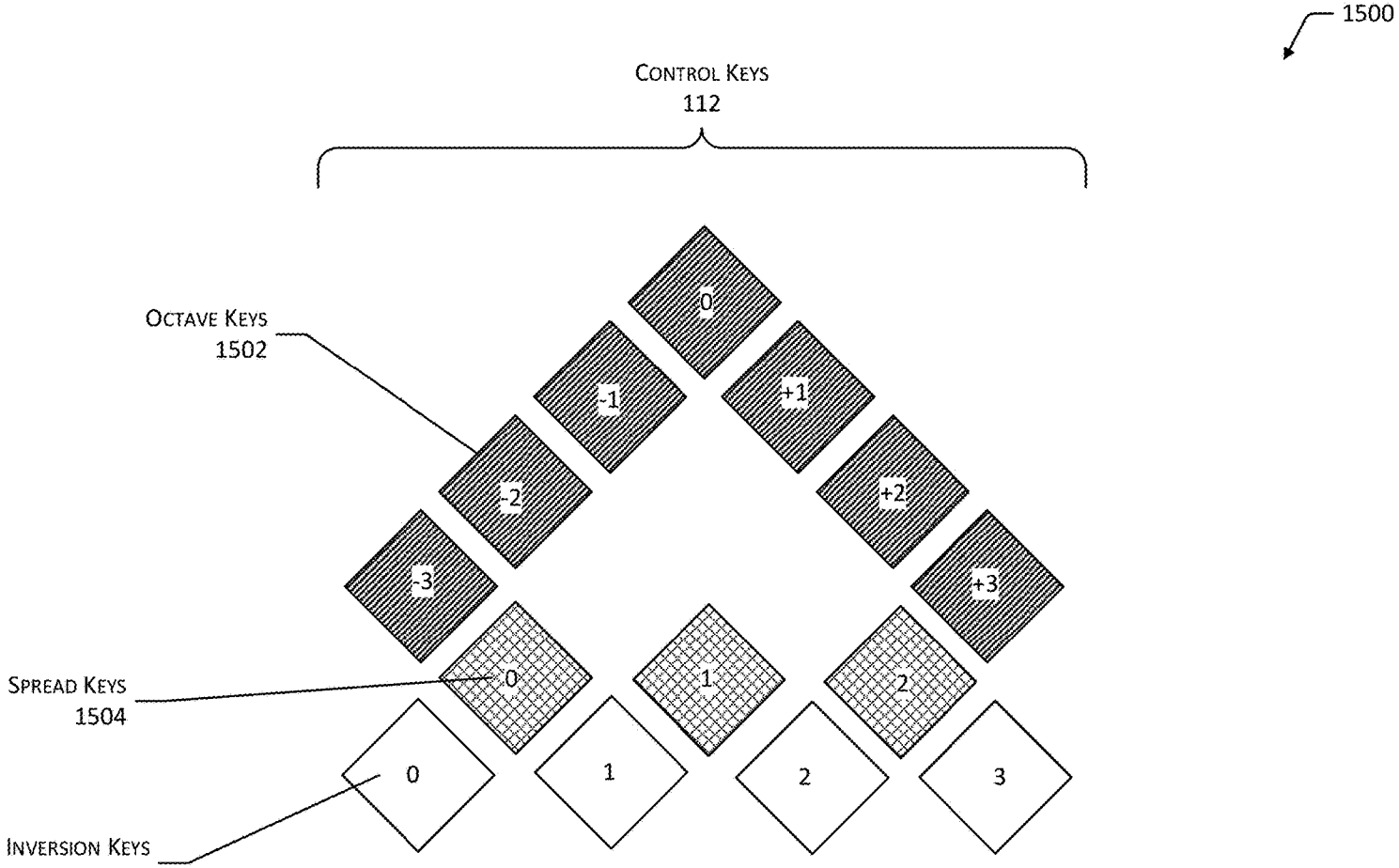
FIG. 15 depicts a layout of control keys, according to one implementation.

FIG. 15 depicts a layout of control keys 112, according to one implementation. In this implementation, there are seven octave keys 1502(−3) through 1502(+3). Activation of these octave keys 1502 may be used to shift the octave for play of one or more of the chord keys 114 or the melody keys 116. Also shown are three spread keys 1504(0) through 1504(2). The spread keys 1504 are used to select the spread of a chord 120. The spread of a chord 120 comprises the interval between the lowest and the highest note. For example, a spread of one results in a displacement of one note in the chord 120 by 1 octave.

The control keys 112 may include inversion keys 1506 (0)-(3). The inversion keys 1506 allow the musician 102 to specify a particular note of the chord 120 that would be placed in the bass (lowest) position.

By utilizing one or more of the octave keys 1502, the spread keys 1504, or the inversion keys 1506, the musician 102 in conjunction with the chord keys 114 is able to quickly and easily play a wide variety of different chords 120 associated with particular scale. Unlike a conventional piano keyboard, the musician 102 does not necessarily need to know the composition of the chord 120 before playing.

In other implementations, other control keys 112 may be present. For example, control keys 112 may be provided that allow for semi-tones, audio effects, and so forth may be present. A greater or fewer number of each type of key 106 may be present. For example, in some implementations there may be nine octave keys 1502, four spread keys 1504, and so forth.

The control keys 112 depicted in this illustration are arranged in an arrowhead pattern, with the octave keys 1502 on uppermost portion, spread keys 1504 arrayed across the base of the arrowhead, and inversion keys 1506 arrayed beneath the spread keys 1504. In other implementations, other layouts may be utilized.

The code example below is provided by way of illustration. It is understood that the functionality provided by the code described above may be implemented in alternative programming languages, data structures, logical constructs and so forth.

Code Example 1

```
#include <MIDI.h>
#include <SPI.h>
#include <SD.h>
#include <SoftwareSerial.h>
#include <MenuBackend.h>
#include <Keypad.h>
#include "FastLED.h"
////////////////////////////////////////////////////////////////////////////////////////////////////
////////
/                                                                                                /
/                                                                                                /
/                                                                                                /
//////////////////CONFIGURE IO & MEMORY ////////////////////////////////
/                                                                                                /
/                                                                                                /
/                                                                                                /
////////////////////////////////////////////////////////////////////////////////////////////////////
////////
//Setup LEDs
#define NUM_LEDS 93
#define DATA_PIN 3
CRGB leds[NUM_LEDS];
MIDI_CREATE_DEFAULT_INSTANCE( );
//DEFINE CHORD KEYPAD
const byte ROWS = 20; //rows
const byte COLS = 4; //columns
//Key lookup chord/melody bank
int keys[ROWS][COLS] = {
  { 80, 76, 72, 68 },
  { 79, 75, 71, 67 },
  { 78, 74, 70, 66 },
  { 77, 73, 69, 65 },
  { 64, 60, 56, 52 },
  { 63, 59, 55, 51 },
  { 62, 58, 54, 50 },
  { 61, 57, 53, 49 },
  { 48, 44, 40, 36 },
  { 47, 43, 39, 35 },
  { 46, 42, 38, 34 },
  { 45, 41, 37, 33 },
  { 32, 28, 24, 20 },
  { 31, 27, 23, 19 },
  { 30, 26, 22, 18 },
  { 29, 25, 21, 17 },
  { 16, 12, 8, 4 },
  { 15, 11, 7, 3 },
  { 14, 10, 6, 2 },
  { 13, 9, 5, 1 }
};
//hardware button input pins for key scan
byte rowPins[ROWS] = { 22, 23, 24, 25, 26, 27, 28, 29, 30, 31, 32, 33, 34,
35, 36, 37, 38, 39, 40, 41 }; //positive
byte colPins[COLS] = { 13, 12, 11, 9 }; //ground
Keypad kpd = Keypad( makeKeymap(keys), rowPins, colPins, ROWS, COLS );
//create keypad
//menu keys
const byte menu_ROWS = 1; //row
const byte menu_COLS = 4; //column
```

-continued

```
int menu_keys[menu_ROWS][menu_COLS] = { { 4, 3, 2, 1 } };
byte menu_rowPins[menu_ROWS] = { 17 }; //positive
byte menu_colPins[menu_COLS] = { 18, 19, 20, 21 }; //ground
Keypad menu_kpd = Keypad( makeKeymap(menu_keys), menu_rowPins, menu_colPins,
menu_ROWS, menu_COLS );
//control keys
const byte shift_ROWS = 3; //row
const byte shift_COLS = 3; //column
int shift_keys[shift_ROWS][shift_COLS] = {
  { 3, 6, 9 },
  { 2, 5, 8 },
  { 1, 4, 7 }
};
byte shift_rowPins[shift_ROWS] = { 47, 48, 49 }; //positive
byte shift_colPins[shift_COLS] = { 44, 45, 46 }; //ground
Keypad shift_kpd = Keypad( makeKeymap(shift_keys), shift_rowPins,
shift_colPins, shift_ROWS, shift_COLS );
//Create a software serial port for LCD communication
SoftwareSerial lcd = SoftwareSerial(0, 5);
int octaveoffset = 0; //initial octave offset
int velocity = 100; //initial velocity
int noteblackout = 0; //used in BL1
//Used for SD data
char SDBuffer[64]; //buffer
int arrayLoad0, arrayLoad1, arrayLoad2, arrayLoad3, arrayLoad4, arrayLoad5,
arrayLoad6, arrayLoad7; //temp storage for parsed data from SD
//Array of notes, start in 'C'
byte colorArray[93]; // 0 - 7 number for which color to display from
colorLookup
String chordlabelArray[48]; //chord labels stored here for LCD display
int currentnotePlaying; //current CHORD that is playing, only one at a time
can fire in BL1
byte noteArray[80][7]; //all notes (chord and melody) are loaded from the SD
into here for use during play
String colorLookup[10] = {"CRGB::Red", "CRGB::DarkOrange",
"CRGB::YellowGreen", "CRGB::Green", "CRGB::Blue", "CRGB::Cyan",
"CRGB::Purple", "CRGB::Plum", "CRGB::Plum", "CRGB::Plum"}; //LED colors
//Used to lookup color values, needed to pass vars
#define REFLECT(value) {#value, value}
template<typename T> struct Reflection {
  const char *name;
  T value;
};
Reflection<CRGB::HTMLColorCode> colors[ ] = {
  REFLECT(CRGB::Red),
  REFLECT(CRGB::DarkOrange),
  REFLECT(CRGB::YellowGreen),
  REFLECT(CRGB::Green),
  REFLECT(CRGB::Blue),
  REFLECT(CRGB::Cyan),
  REFLECT(CRGB::Purple),
  REFLECT(CRGB::Plum)
};
byte chordData[7] = {99, 99, 99, 99, 99, 99, 99}; //chord list. 99 is
indicator that is empty. *width of 7 used for beta testing.
byte melodyData[7] = {99, 99, 99, 99, 99, 99, 99}; //current playing melody
notes
byte donotshutoff[7] = {0};
String currentLoadedChord; //store in EEPROM
char prevLoadedFile[50]; //store in EEPROM
////////////////////////////////////////////////////////////////////////////////
////////
/                                                                          /
/                                                                          /
/                                                                          /
//////////////////////////////////////Code//////////////////////////////////
////////
/                                                                          /
/                                                                          /
/                                                                          /
////////////////////////////////////////////////////////////////////////////////
////////
//initialize components
void setup( ) {
  MIDI.begin(MIDI_CHANNEL_OMNI); //connect to MIDI
  pinMode(toggleMenu, INPUT_PULLUP);
  setupLCD( );
  setupMenu( );
  setupSD( );
```

-continued

```
  loadSD("/001/001/00001.txt", "A Dominant Bebop"); //load first file
off SD
}
//will repeat until the device is turned off
void loop( ) {
  readKeys( ); //read chords/melody
}
//performs the keyscan of the chord/melody keys
void readKeys( ) {
  if (kpd.getKeys( ))
  {
    for (int i = 0; i < LIST_MAX; i++) //scan the keylist
    {
      if ( kpd.key[i].stateChanged ) //find keys that changed state
      {
        switch (kpd.key[i].kstate) { //report active key state : IDLE,
PRESSED, HOLD, or RELEASED
          case PRESSED:
            //CHORD PRESS:
            if ( (kpd.key[i].kint - 1) < 48) {
              buttonPressed(kpd.key[i].kint - 1); //deincrement from human
to computer counting when sending key ( 0 - n)
              registerKey(kpd.key[i].kint - 1);
            }
            //MELODY PRESS:
            else if ( (kpd.key[i].kint - 1) >= 48 ) {
              melodyPressed(kpd.key[i].kint - 1);
              registerMelody(kpd.key[i].kint - 1);
            }
            break;
          case RELEASED:
            //CHORD RELEASED:
            if ( (kpd.key[i].kint - 1) < 48) {
              buttonReleased(kpd.key[i].kint - 1);
              unregisterKey(kpd.key[i].kint - 1);
            }
            //MELODY RELEASED
            else if ( (kpd.key[i].kint - 1) >= 48 ) {
              melodyReleased(kpd.key[i].kint - 1);
              unregisterMelody(kpd.key[i].kint - 1);
            }
            break;
        }
      }
    }
  }
}
//melody key is pressed
void melodyPressed(int buttonPin) {
  MIDI.sendNoteOn(int(noteArray[buttonPin][0] + octaveoffset), velocity, 1);
}
//melody key is released
void melodyReleased(int buttonPin) {
  MIDI.sendNoteOff(int(noteArray[buttonPin][0] + octaveoffset), velocity,
1);
}
//executes when a chord key is pressed
void buttonPressed(int buttonPin) {
  if ( (noteblackout == 0) && (buttonPin < 48) ) //if is a chord is allowed
to be played and if is a chord
  {
    for (int i = 0; i < 6; i++) { //only 7 possible notes in a chord
      {
        if (noteArray[buttonPin][i] != 0) //as long as not empty
        {
          MIDI.sendNoteOn(int(noteArray[buttonPin][i] + octaveoffset),
velocity, 1); //send chord note on
        }
      }
      //Display current chord on LCD
      lcd.write(0xFE);
      lcd.write(0x58);
      lcd.print(chordlabelArray[buttonPin]);
      noteblackout = 1; //no other chord can be struck
      currentnotePlaying = buttonPin; //keep track of which chord is
currently playing
    }
  }
}
```

-continued

```
//executes when a chord key is released
void buttonReleased(int buttonPin) {
  if ( (noteblackout == 1) && (buttonPin == currentnotePlaying) && (buttonPin
< 48) ) //must be a chord turning off
  {
    //clear key conflicts array
    for (int i = 0; i < 6; i++)
      donotshutoff[i] = 0;
    //check key conflicts, fill the array
    checkkeyConflicts(buttonPin);
    for (int i = 0; i < 6; i++) //traverse through currently pressed notes
    {
      if (noteArray[buttonPin][i] == 0) //if current note is a zero then we
have reached the end
        break;
      else {
        for (int m = 0; m < 6; m++) //for each currently pressed note,
check to see if match on do not stop list
        {
          if (donotshutoff[m] == 0) { //if at end of do-not-stop list then
there were no hits, fire off the note-off
            MIDI.sendNoteOff(int(noteArray[buttonPin][i] + octaveoffset),
velocity, 1);
            break;
          }
          if ( noteArray[buttonPin][i] == donotshutoff[m] )
        {
          break; //found match on do not shut off list, break out
        }
      }
    }
  }
  //remove chord title from LCD
  lcd.write(0xFE);
  lcd.write(0x58);
  noteblackout = 0; //reset noteblackout to 0, this will allow next chord
to be pressed
  if ( (findnextKey(buttonPin) != 99) && (buttonPin == currentnotePlaying)
) //if theres another key hit and if the current pressed was just released
    buttonPressed(findnextKey(buttonPin)); //pass next key in waiting list
  }
}
//track melody key that is pressed
void registerMelody(int key) {
  chronorderKeys(currentMelody); //pass the array to chron order & clean
  for (int i = 0; i < 7; i++)
  {
    if (currentMelody[i] == 99) { //if space available store
      currentMelody[i] = noteArray[key][0];
      break;
    }
  }
}
//melody key is released then we do not need to keep track of it
void unregisterMelody(int key) {
  for (int i = 0; i < 7; i++)
  {
    if (currentMelody[i] == noteArray[key][0])
      currentMelody[i] = 99;
    }
    chronorderKeys(currentMelody);
}
//add new physical chord key to the key waiting list
void registerKey(int key) {
  chronorderKeys(chordData); //pass the array to chron order & clean
  for (int i = 0; i < 7; i++) {
    if (chordData[i] == 99) { //if space available store (99 is non-note)
      chordData[i] = key;
      break;
    }
  }
}
//Remove a chord key from the key waiting list
void unregisterKey(int key) {
  for (int i = 0; i < 7; i++) {
    if (chordData[i] == key)
      chordData[i] = 99;
  }
  chronorderKeys(chordData);
```

-continued

```
}
//sometimes keys have been removed in the middle of the chordData array,
this will clean out empty slots
//
//Example array BEFORE: 09 22 99 21 15 99 99
//Example array AFTER: 09 22 21 15 99 99 99 (99 is removed from the
center)
void chronorderKeys(byte chronarray[ ] ) {
  for (int i = 0; i < 7; i++)
  {
    if (chordData[i] == 99) //if empty space at queue
    {
      for (int j = 1; j < (7 - i); j++) {//start search for any keys that
need to come down the line
        if (chordData[i + j] != 99) {
          chordData[i] = chordData[i + j]; //set empty space as next in
line
          chordData[i + j] = 99; //set old space to 99
          break;
        }
      }
    }
  }
}
//check conflicts before sending note-off data. notes that shouldn't be
turned off are placed in donotshutoff array
void checkkeyConflicts(int key) {
  int pos = 0;
  for (int i = 0; i < 7; i++)
  {
    for (int j = 0; j < 7; j++)
    {
      if (noteArray[key][j] == 0)
        break;
      if (noteArray[key][j] == currentMelody[i]) {
        donotshutoff[pos] = currentMelody[i];
        pos++;
      }
    }
  }
}
//return next key in chord array
int findnextKey(int key) {
  int returnkey = 99;
  for (int i = 0; i < 6; i++) {
    if (chordData[i] == key)
    {
      returnkey = chordData[i + 1];
      break;
    }
  }
  return returnkey;
}
```

The system may be implemented as described in one or more of the following clauses.

Clause 1: A system comprising: a hardware processor; a communication interface; a first plurality of keys to provide input to the hardware processor, wherein each of the first plurality of keys is configurable to present a designated color from a plurality of colors; a second plurality of keys to provide input to the hardware processor, wherein each of the second plurality of keys is configurable to present a designated color from the plurality of colors; one or more memories storing first computer-executable instructions; and the one or more hardware processors to execute the first computer-executable instructions to: determine a specified scale comprising a plurality of designated musical notes; assign an $n^{th}$ key of the first plurality of keys to represent an $i^{th}$ note of the designated musical notes; determine an $r^{th}$ color associated with the $i^{th}$ note; configure the $n^{th}$ key to present the $r^{th}$ color; determine a $c^{th}$ chord comprising a plurality of notes from the designated musical notes; assign a $j^{th}$ key of the second plurality of keys to represent the $c^{th}$ chord; configure the $j^{th}$ key to present the $r^{th}$ color; and wherein n, i, r, c, and j are representative of non-zero positive integer values.

Clause 2: The system of clause 1, wherein the first plurality of keys comprises thirty-two keys arranged in four rows of eight keys and the second plurality of keys comprises forty-eight keys arranged in four rows of twelve keys.

Clause 3: The system of one or more of clauses 1 or 2, wherein the $c^{th}$ chord assigned to the $j^{th}$ key is an inverted chord.

Clause 4: The system of one or more of clauses 1 through 3, wherein one or more of the first plurality of keys or the second plurality of keys comprise one or more of: one or more light emitting diodes (LED), one or more light emitting quantum dots, one or more electroluminescent elements, one or more electrophoretic elements, one or more cholesteric elements, or one or more optically interferometric elements.

Clause 5: A system comprising: a hardware processor; a communication interface; a first plurality of keys to provide input to the hardware processor; a second plurality of keys to provide input to the hardware processor; one or more memories storing first computer-executable instructions; and the one or more hardware processors to execute the first computer-executable instructions to: determine scale data that associates one or more of the first plurality or the second plurality of keys with one or more notes in a musical scale, wherein one or more of the first plurality of keys associate a particular key to a particular chord, and one or more of the second plurality of keys associate a particular key to a particular note; receive input indicative of a key press of a first key of the first plurality of keys; determine the key press is a valid key press; add, to current note(s) playing data, data indicative of the notes in the particular chord that is associated with the valid key press; generate a first command set comprising a note on command for each of the one or more notes that are associated with the valid key press; and send, using the communication interface, the first command set.

Clause 6: The system of clause 5, further comprising: one or more memories storing second computer-executable instructions; and the one or more hardware processors to execute the second computer-executable instructions to: receive input indicative of a key release of the first key of the first plurality of keys; determine notes associated with the released first key are in the current note(s) playing data; remove the notes associated with the released first key from the current note(s) playing data; determine a valid key release indicative of the note(s) associated with the released first key; generate a second command set comprising a note off command for at least a portion of the one or more notes that are associated with the valid key release; send, using the communication interface, the second command set; determine next note(s) stored in chord waiting data; determine a valid key press indicative of the next note(s); generate a third command set comprising a note on command for each of the one or more notes that are associated with the valid key press; send, using the communication interface, the third command set; and remove the note(s) associated with the released first key from the chord waiting data.

Clause 7: The system of one or more of clauses 5 or 6, further comprising: one or more memories storing second computer-executable instructions; and the one or more hardware processors to execute the second computer-executable instructions to: receive input indicative of a key press of a second key of the first plurality of keys; determine the first key and the second key are pressed contemporaneously; and add, to chord waiting data, data indicative of the notes in the particular chord that is associated with the second key.

Clause 8: The system of one or more of clauses 5 through 7, further comprising: one or more memories storing second computer-executable instructions; and the one or more hardware processors to execute the second computer-executable instructions to: receive input indicative of a key release of the first key of the first plurality of keys; determine that no notes associated with the released first key are in the current note(s) playing data; and remove the notes associated with the released first key from chord waiting data.

Clause 9: The system of one or more of clauses 5 through 8, further comprising: one or more memories storing second computer-executable instructions; and the one or more hardware processors to execute the second computer-executable instructions to: receive input indicative of a key press of a second key of the first plurality of keys; determine one or more other keys in the first plurality of keys are currently pressed; determine, using current chord key data, that a current chord is playing; determine a valid key release indicative of the current chord that is playing; generate a second command set comprising a note off command for at least a portion of the one or more notes that are associated with the valid key release; send, using the communication interface, the second command set; generate a third command set comprising a note on command for each of the one or more notes that are associated with the second key; and send, using the communication interface, the third command set.

Clause 10: The system of one or more of clauses 5 through 9, further comprising: one or more memories storing second computer-executable instructions; and the one or more hardware processors to execute the second computer-executable instructions to: receive input indicative of a key release of the first key of the first plurality of keys; remove, from the current note(s) playing data, the notes associated with the released first key; generate a second command set comprising a note off command for at least a portion of the one or more notes that are associated with the released first key; and send, using the communication interface, the second command set.

Clause 11: The system of one or more of clauses 5 through 10, further comprising: one or more memories storing second computer-executable instructions; and the one or more hardware processors to execute the second computer-executable instructions to: receive input indicative of a key release of the first key of the first plurality of keys; determine the note(s) associated with the key release are not present in the current note(s) playing data; generate a second command set comprising a note off command for at least a portion of the one or more notes that are associated with the valid key release; send, using the communication interface, the second command set; and remove, from the current note(s) playing data, data indicative of the notes in the particular chord that is associated with the key release.

Clause 12: A method comprising: determining a specified scale comprising a plurality of designated musical notes; determining a plurality of chords associated with the specified scale; associating a particular key within a first plurality of keys of an input device with each of the designated musical notes; associating, for at least a subset of the plurality of chords, a particular key within a second plurality of keys of the input device with each of the plurality of chords in the subset of the plurality of chords; determining a visual indicia associated with each of the designated musical notes; configuring one or more keys in the first plurality of keys with the visual indicia associated with the designated musical note; and configuring a visual indicia of one or more keys in the second plurality of keys with the visual indicia associated with a root note of the one of the plurality of chords.

Clause 13: The method of clause 12, wherein the subset of chords comprises more than half of non-inverted chords associated with the specified scale.

Clause 14: The method of one or more of clauses 12 or 13, wherein the visual indicia comprises one or more of: color, text, image, or shape of the key.

Clause 15: The method of one or more of clauses 12 through 14, further comprising: presenting, using one or more display devices, one or more of the first plurality of keys or the second plurality of keys.

Clause 16: The method of one or more of clauses 12 through 15, further comprising: receiving input indicative of a key press of a first key of the second plurality of keys; determining one or more other keys in the second plurality of keys are currently pressed; determining, using current chord key data, that a current chord is playing; determining a valid key release indicative of the current chord that is playing; generating a first command set comprising a note off command for at least a portion of one or more notes that are associated with the valid key release; sending the first command set; generating a second command set comprising a note on command for each of one or more notes that are associated with the first key; and sending the second command set.

Clause 17: The method of one or more of clauses 12 through 16, further comprising: receiving input indicative of a key release of a first key of the second plurality of keys; removing, from current note(s) playing data, notes associated with the released first key; generating a first command set comprising a note off command for at least a portion of the one or more notes that are associated with the released first key; and sending the first command set.

Clause 18: The method of one or more of clauses 12 through 17, further comprising: receiving input indicative of a key release of a first key of the second plurality of keys; determining notes associated with the released first key are in current note(s) playing data; removing the notes associated with the released first key from the current note(s) playing data; generating a first command set comprising a note off command for at least a portion of the one or more notes that are associated with the released first key; sending the first command set; determining next note(s) stored in chord waiting data; determining a valid key press indicative of the next note(s); generating a second command set comprising a note on command for each of the one or more notes that are associated with the valid key press; sending the second command set; and removing the note(s) associated with the released first key from the chord waiting data.

Clause 19: The method of one or more of clauses 12 through 18, further comprising: determining that a first key and a second key of the second plurality of keys are pressed contemporaneously; and adding, to chord waiting data, data indicative of notes in a particular chord that is associated with the second key.

Clause 20: The method of one or more of clauses 12 through 19, further comprising: receiving input indicative of a key release of a first key of the second plurality of keys; determining that no notes associated with the released first key are in current note(s) playing data; and removing the notes associated with the released first key from chord waiting data.

The processes discussed in this disclosure may be implemented in hardware, software, or a combination thereof. In the context of software, the described operations represent computer-executable instructions stored on one or more computer-readable storage media that, when executed by one or more hardware processors, perform the recited operations. Generally, computer-executable instructions include routines, programs, objects, components, data structures, and the like that perform particular functions or implement particular abstract data types. Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Embodiments may be provided as a software program or computer program product including a non-transitory computer-readable storage medium having stored thereon instructions (in compressed or uncompressed form) that may be used to program a computer (or other electronic device) to perform processes or methods described in this disclosure. The computer-readable storage medium may be one or more of an electronic storage medium, a magnetic storage medium, an optical storage medium, a quantum storage medium, and so forth. For example, the computer-readable storage media may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further, embodiments may also be provided as a computer program product including a transitory machine-readable signal (in compressed or uncompressed form). Examples of transitory machine-readable signals, whether modulated using a carrier or unmodulated, include, but are not limited to, signals that a computer system or machine hosting or running a computer program can be configured to access, including signals transferred by one or more networks. For example, the transitory machine-readable signal may comprise transmission of software by the Internet.

Separate instances of these programs can be executed on or distributed across any number of separate computer systems. Although certain steps have been described as being performed by certain devices, software programs, processes, or entities, this need not be the case, and a variety of alternative implementations will be understood by those having ordinary skill in the art.

Additionally, those having ordinary skill in the art will readily recognize that the techniques described above can be utilized in a variety of devices, environments, and situations. Although the subject matter has been described in language specific to structural features or methodological acts, it is to be understood that the subject matter defined in the appended claims is not necessarily limited to the specific features or acts described. Rather, the specific features and acts are disclosed as exemplary forms of implementing the claims.

What is claimed is:

1. A system comprising:

one or more hardware processors;

a communication interface;

a first plurality of keys to provide input to the one or more hardware processors, wherein each of the first plurality of keys is configurable to present a designated color from a plurality of colors;

a second plurality of keys to provide input to the one or more hardware processors, wherein each of the second plurality of keys is configurable to present a designated color from the plurality of colors;

one or more memories storing first computer-executable instructions; and the one or more hardware processors to execute the first computer-executable instructions to:

determine a specified scale comprising a plurality of designated musical notes;

assign an $n^{th}$ key of the first plurality of keys to represent an $i^{th}$ note of the designated musical notes;

determine an $r^{th}$ color associated with the $i^{th}$ note;

configure the $n^{th}$ key to present the $r^{th}$ color;

determine a $c^{th}$ chord comprising a plurality of notes from the designated musical notes;

assign a $j^{th}$ key of the second plurality of keys to represent the $c^{th}$ chord;

configure the $j^{th}$ key to present the $r^{th}$ color; and wherein n, i, r, c, and j are representative of non-zero positive integer values.

2. The system of claim 1, wherein the first plurality of keys comprises forty-eight keys arranged in four rows of twelve keys and the second plurality of keys comprises forty-eight keys arranged in four rows of twelve keys.

3. The system of claim 1, wherein the $c^{th}$ chord assigned to the $j^{th}$ key is an inverted chord.

4. The system of claim 1, wherein one or more of the first plurality of keys or the second plurality of keys comprise one or more of:

one or more light emitting diodes (LED),
one or more light emitting quantum dots,
one or more electroluminescent elements,
one or more electrophoretic elements,
one or more cholesteric elements, or
one or more optically interferometric elements.

5. A system comprising:

one or more hardware processors;
a communication interface;
a first plurality of keys to provide input to the one or more hardware processors;
a second plurality of keys to provide input to the one or more hardware processors;
one or more memories storing first computer-executable instructions; and
the one or more hardware processors to execute the first computer-executable instructions to:
determine scale data that associates one or more of the first plurality of keys or the second plurality of keys with one or more notes in a musical scale, wherein one or more of the first plurality of keys associate a particular key to a particular chord, and one or more of the second plurality of keys associate a particular key to a particular note;
receive input indicative of a key press of a first key of the first plurality of keys;
determine the key press is a valid key press;
add, to current note(s) playing data, data indicative of the notes in the particular chord that is associated with the valid key press;
generate a first command set comprising a note on command for each of the one or more notes that are associated with the valid key press; and
send, using the communication interface, the first command set.

6. The system of claim 5, further comprising:

one or more memories storing second computer-executable instructions; and
the one or more hardware processors to execute the second computer-executable instructions to:
receive input indicative of a key release of the first key of the first plurality of keys;
determine notes associated with the released first key are in the current note(s) playing data;
remove the notes associated with the released first key from the current note(s) playing data;
determine a valid key release indicative of the note(s) associated with the released first key;
generate a second command set comprising a note off command for at least a portion of the one or more notes that are associated with the valid key release;
send, using the communication interface, the second command set;
determine next note(s) stored in chord waiting data;
determine a valid key press indicative of the next note(s);
generate a third command set comprising a note on command for each of the one or more notes that are associated with the valid key press;
send, using the communication interface, the third command set; and
remove the note(s) associated with the released first key from the chord waiting data.

7. The system of claim 5, further comprising:

one or more memories storing second computer-executable instructions; and
the one or more hardware processors to execute the second computer-executable instructions to:
receive input indicative of a key press of a second key of the first plurality of keys;
determine the first key and the second key are pressed contemporaneously; and
add, to chord waiting data, data indicative of the notes in the particular chord that is associated with the second key.

8. The system of claim 5, further comprising:

one or more memories storing second computer-executable instructions; and
the one or more hardware processors to execute the second computer-executable instructions to:
receive input indicative of a key release of the first key of the first plurality of keys;
determine that no notes associated with the released first key are in the current note(s) playing data; and
remove the notes associated with the released first key from chord waiting data.

9. The system of claim 5, further comprising:

one or more memories storing second computer-executable instructions; and
the one or more hardware processors to execute the second computer-executable instructions to:
receive input indicative of a key press of a second key of the first plurality of keys;
determine one or more other keys in the first plurality of keys are currently pressed;
determine, using current chord key data, that a current chord is playing;
determine a valid key release indicative of the current chord that is playing;
generate a second command set comprising a note off command for at least a portion of the one or more notes that are associated with the valid key release;
send, using the communication interface, the second command set;
generate a third command set comprising a note on command for each of the one or more notes that are associated with the second key; and
send, using the communication interface, the third command set.

10. The system of claim 5, further comprising:

one or more memories storing second computer-executable instructions; and
the one or more hardware processors to execute the second computer-executable instructions to:
receive input indicative of a key release of the first key of the first plurality of keys;
remove, from the current note(s) playing data, the notes associated with the released first key;
generate a second command set comprising a note off command for at least a portion of the one or more notes that are associated with the released first key; and
send, using the communication interface, the second command set.

11. The system of claim 5, further comprising:
one or more memories storing second computer-executable instructions; and
the one or more hardware processors to execute the second computer-executable instructions to:
receive input indicative of a key release of the first key of the first plurality of keys;
determine the note(s) associated with the key release are not present in the current note(s) playing data;
generate a second command set comprising a note off command for at least a portion of the one or more notes that are associated with the key release;
send, using the communication interface, the second command set; and
remove, from the current note(s) playing data, data indicative of the notes in the particular chord that is associated with the key release.

12. A method comprising:
determining a specified scale comprising a plurality of designated musical notes;
determining a plurality of chords associated with the specified scale;
associating a particular key within a first plurality of keys of an input device with each of the designated musical notes;
associating, for at least a subset of the plurality of chords, a particular key within a second plurality of keys of the input device with each of the plurality of chords in the subset of the plurality of chords;
determining a visual indicia associated with each of the designated musical notes;
configuring one or more keys in the first plurality of keys with the visual indicia associated with the designated musical note; and
configuring a visual indicia of one or more keys in the second plurality of keys with the visual indicia associated with a root note of the one of the plurality of chords.

13. The method of claim 12, wherein the subset of the plurality of chords comprises more than half of non-inverted chords associated with the specified scale.

14. The method of claim 12, wherein the visual indicia comprises one or more of:
color,
text,
image, or
shape of the key.

15. The method of claim 12, further comprising:
presenting, using one or more display devices, one or more of the first plurality of keys or the second plurality of keys.

16. The method of claim 12, further comprising:
receiving input indicative of a key press of a first key of the second plurality of keys;
determining one or more other keys in the second plurality of keys are currently pressed;
determining, using current chord key data, that a current chord is playing;
determining a valid key release indicative of the current chord that is playing;
generating a first command set comprising a note off command for at least a portion of one or more notes that are associated with the valid key release;
sending the first command set;
generating a second command set comprising a note on command for each of one or more notes that are associated with the first key; and
sending the second command set.

17. The method of claim 12, further comprising:
receiving input indicative of a key release of a first key of the second plurality of keys;
removing, from current note(s) playing data, notes associated with the released first key;
generating a first command set comprising a note off command for at least a portion of the one or more notes that are associated with the released first key; and
sending the first command set.

18. The method of claim 12, further comprising:
receiving input indicative of a key release of a first key of the second plurality of keys;
determining notes associated with the released first key are in current note(s) playing data;
removing the notes associated with the released first key from the current note(s) playing data;
generating a first command set comprising a note off command for at least a portion of the one or more notes that are associated with the released first key;
sending the first command set;
determining next note(s) stored in chord waiting data;
determining a valid key press indicative of the next note(s);
generating a second command set comprising a note on command for each of the one or more notes that are associated with the valid key press;
sending the second command set; and
removing the note(s) associated with the released first key from the chord waiting data.

19. The method of claim 12, further comprising:
determining that a first key and a second key of the second plurality of keys are pressed contemporaneously; and
adding, to chord waiting data, data indicative of notes in a particular chord that is associated with the second key.

20. The method of claim 12, further comprising:
receiving input indicative of a key release of a first key of the second plurality of keys;
determining that no notes associated with the released first key are in current note(s) playing data; and
removing the notes associated with the released first key from chord waiting data.

* * * * *